US010797425B1

(12) United States Patent
Young

(10) Patent No.: US 10,797,425 B1
(45) Date of Patent: Oct. 6, 2020

(54) COMPACT TRAVEL ADAPTER AND EXTENSION CORD

(71) Applicant: Paul Zeng Universal Supplies, LLC, Cheyenne, WY (US)

(72) Inventor: Michael Young, Cheyenne, WY (US)

(73) Assignee: Paul Zeng Universal Supplies, LLC, Cheyenne, WY (US)

( * ) Notice: Subject to any disclaimer, the term of this patent is extended or adjusted under 35 U.S.C. 154(b) by 0 days.

(21) Appl. No.: 16/597,177

(22) Filed: Oct. 9, 2019

(51) Int. Cl.
*H01R 13/35* (2006.01)
*H01R 13/639* (2006.01)
*H01R 13/72* (2006.01)

(52) U.S. Cl.
CPC ..... *H01R 13/35* (2013.01); *H01R 13/6392* (2013.01); *H01R 13/72* (2013.01)

(58) Field of Classification Search
CPC .. H01R 13/35; H01R 13/631; H01R 13/6392; H01R 13/6395; H01R 13/72; H01R 13/73; H01R 13/74; H01R 13/741; H01R 13/743
USPC ..... 439/501, 502, 528
See application file for complete search history.

(56) References Cited

U.S. PATENT DOCUMENTS 5,071,367 A * 12/1991 Luu ..... H01R 13/72 191/12.4
6,574,120 B1 * 6/2003 Chou ..... H02G 11/02 200/52 R
6,589,069 B1 * 7/2003 Liao ..... H01R 13/72 320/103
6,722,917 B2 * 4/2004 Huang ..... H01R 13/6658 439/501
6,848,937 B1 * 2/2005 Hsiao ..... H02G 11/02 439/501
7,232,349 B1 * 6/2007 Chen ..... H01R 13/6392 439/810
7,911,757 B2 * 3/2011 Hsu ..... H01R 13/6666 361/118
10,468,842 B2 * 11/2019 Sun ..... G06F 1/263
2005/0255743 A1 * 11/2005 Lin ..... H01R 31/06 439/502
2008/0090434 A1 * 4/2008 Lin ..... H01R 13/72 439/131
2010/0279518 A1 * 11/2010 Watanabe ..... H01R 13/72 439/40
2014/0094065 A1 * 4/2014 Martin ..... H01R 13/72 439/638
2020/0076113 A1 * 3/2020 Xu ..... H01R 13/506
2020/0091749 A1 * 3/2020 Wen ..... H01R 13/72

* cited by examiner

*Primary Examiner* — Oscar C Jimenez
(74) *Attorney, Agent, or Firm* — Schiff Hardin LLP

(57) ABSTRACT

A travel adapter and accompanying extension cord are disclosed. The travel adapter and extension cord are designed to work in conjunction with swappable mating adapter plugs. The travel adapter enables compact and convenient storage using an advantageous interlocking design that also protects the travel adapter during transport.

20 Claims, 40 Drawing Sheets

100

100

COMPACT TRAVEL ADAPTER AND EXTENSION CORD

TECHNICAL FIELD

Aspects described herein generally relate to a travel adapter that may be implemented as a power strip and, more particularly, to a compact travel adapter arrangement with a mating extension cord.

BACKGROUND

Increasing airline restrictions on luggage weight, as well as the general convenience of traveling with less bulk, has resulted in passengers seeking out ways to lighten their packing load while traveling. At the same time, international airline travel continues to increase, particularly among younger generations. Recent advances in international mobile phone connectivity also allows travelers to use their mobile phones in addition to other portable electronic devices in other countries. Many travelers therefore travel with a travel adapter and/or voltage converter.

But because different countries use different shapes of receptacles, prongs, and mating plugs, travel adapters typically provide a physical conversion between a standard type of plug for the electronic device and a plug type for a different country. Moreover, because other countries utilize different alternating current (AC) voltages, voltage converters may also be used by travelers to convert the AC voltage of one country to one that is ordinarily used by the electronic device. Some AC adapters incorporate voltage converters, whereas other adapters rely on the ability of modern electronic devices to operate over a range of AC voltages. Conventional travel adapters and voltage converters, however, are typically large and heavy, and do not supply adequate access to power outlets or other charging means despite their considerable bulk.

BRIEF DESCRIPTION OF THE DRAWINGS/FIGURES

The accompanying drawings, which are incorporated herein and form a part of the specification, illustrate the aspects of the present disclosure and, together with the description, and further serve to explain the principles of the aspects and to enable a person skilled in the pertinent art to make and use the aspects.

FIGS. 1C-1 and 1C-2 illustrate a bottom view of a travel adapter, in accordance with an aspect of the disclosure.

FIGS. 1D-1 and 1D-2 illustrates a side view of a travel adapter, in accordance with an aspect of the disclosure.

Figure 1A:
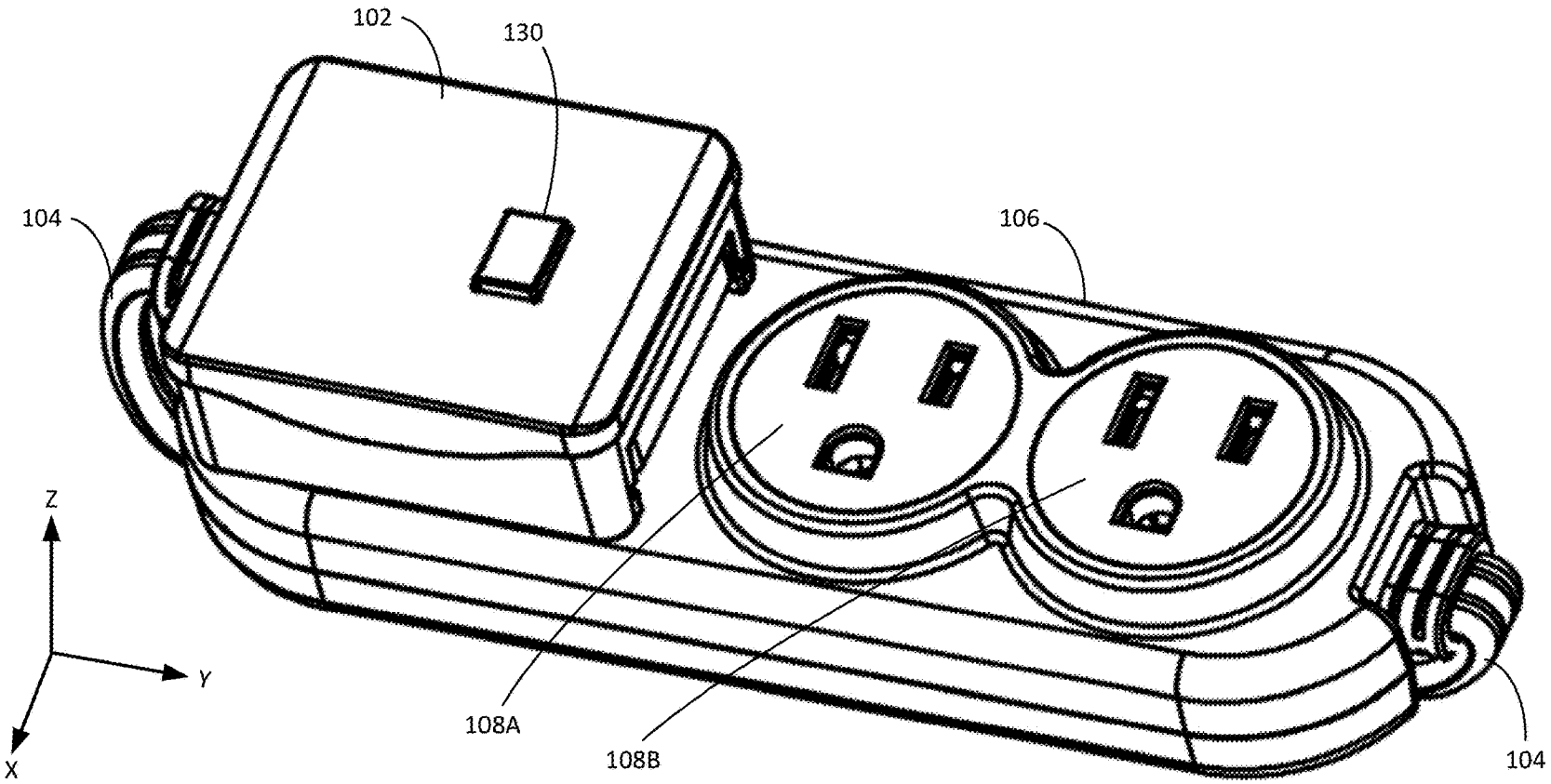
FIG. 1A illustrates a three-dimensional view of a travel adapter, in accordance with an aspect of the disclosure.
Figures 1, 1B:
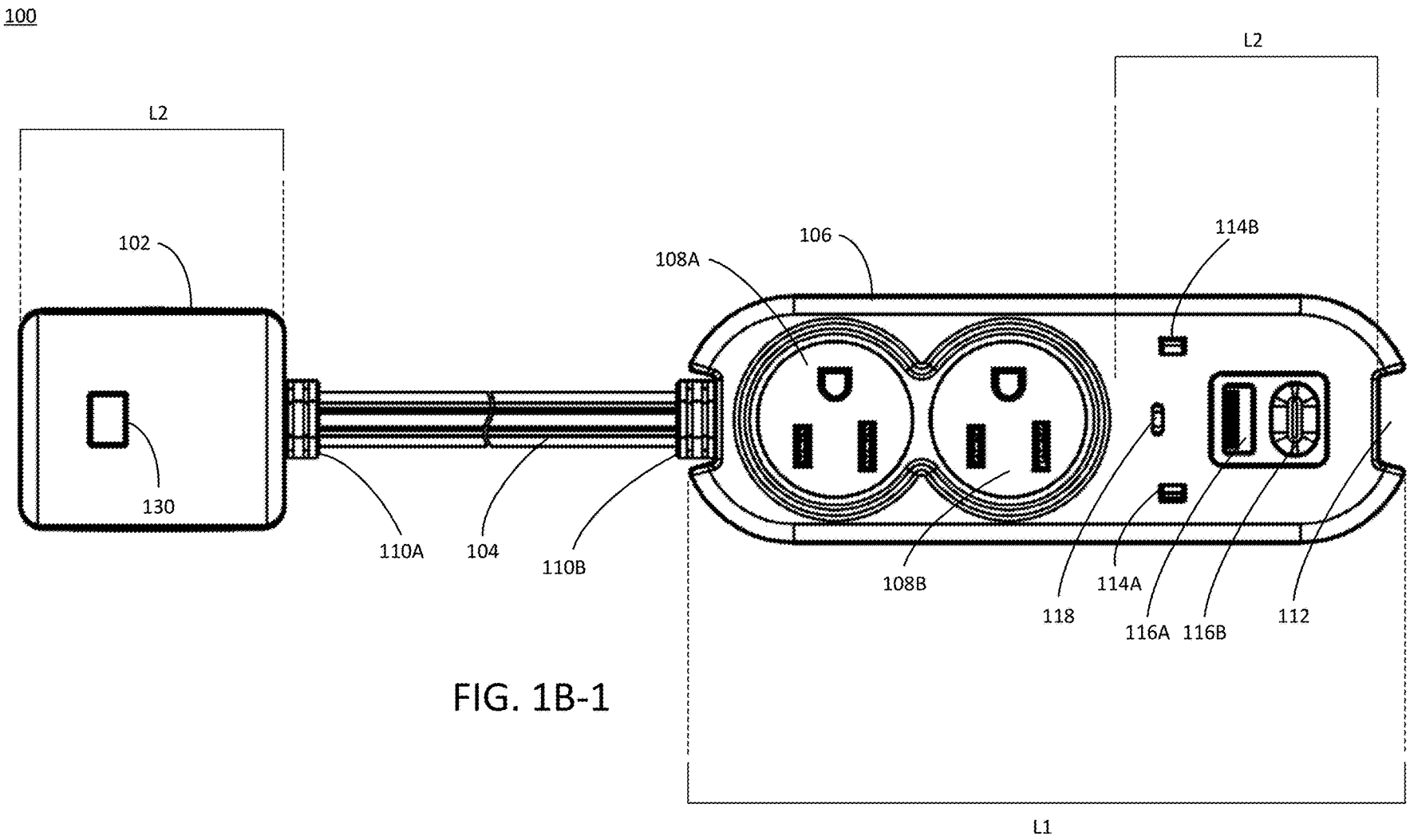
FIGS. 1B-1 and 1B-2 illustrate a top view of a travel adapter, in accordance with an aspect of the disclosure.
Figures 1, 1B, 2:
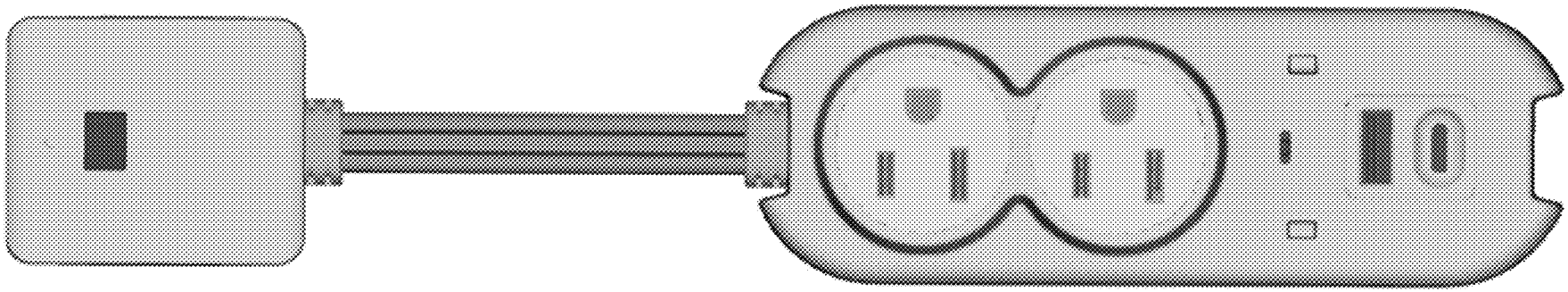
Figures 1, 1C:
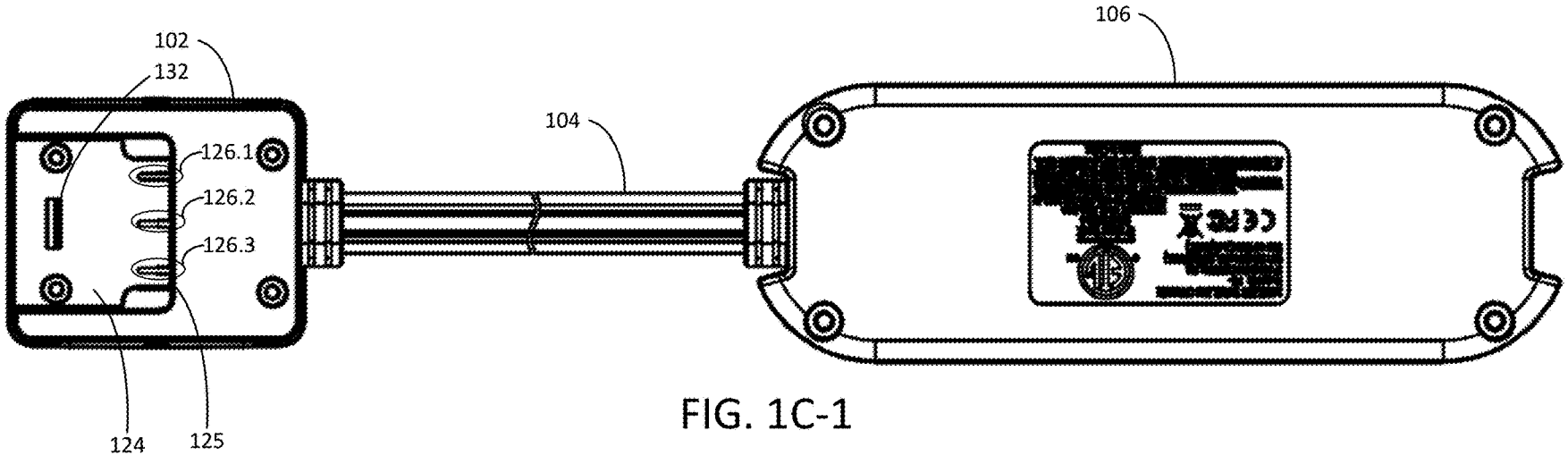
Figures 1, 1C, 2:
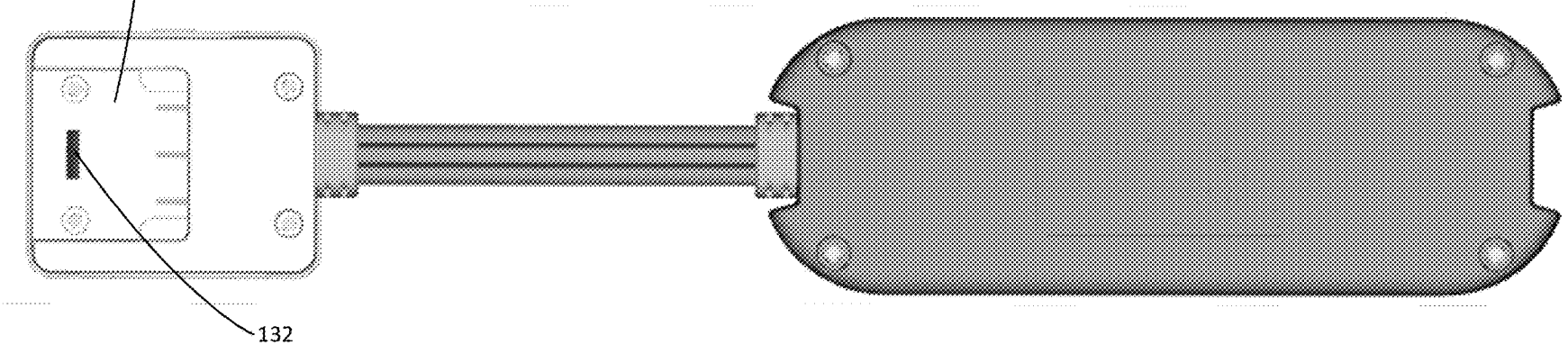
Figures 1, 1D:
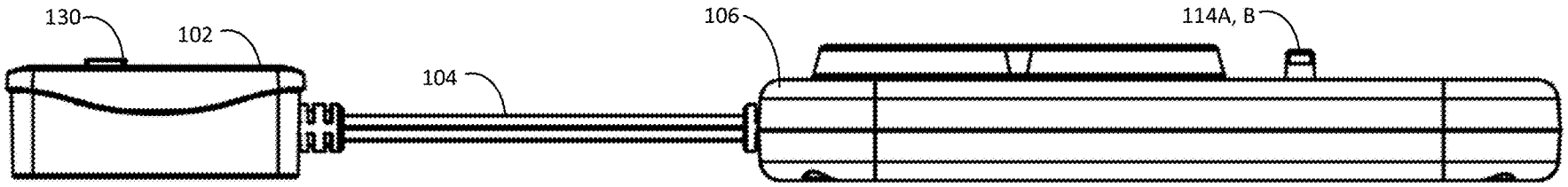
Figures 1, 1D, 2:
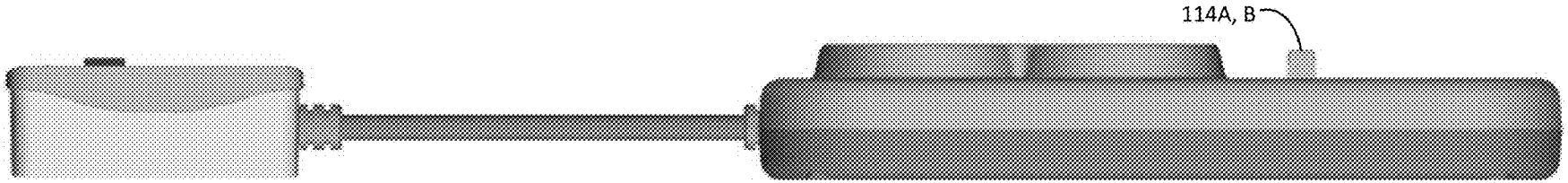
Figures 1, 1E:
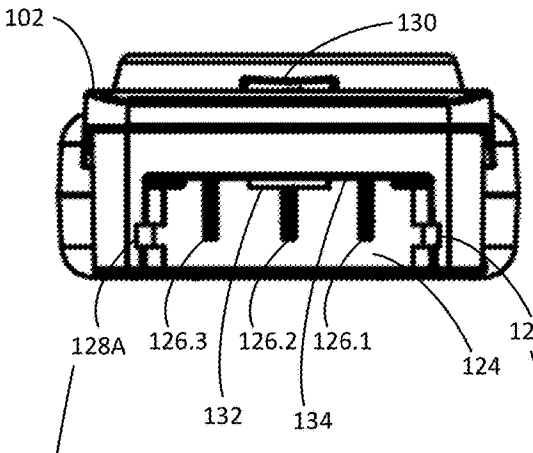
Figures 1, 1E, 2:
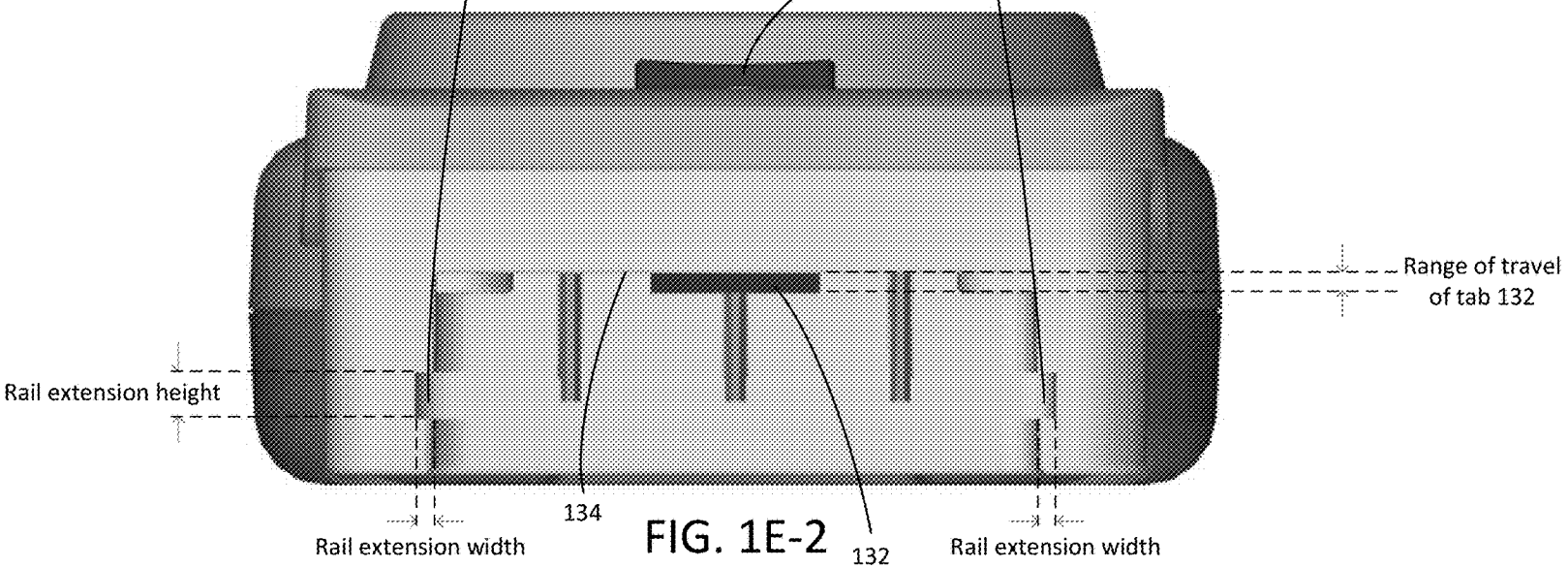

FIGS. 1E-1 and 1E2 illustrate a front view of a travel adapter, in accordance with an aspect of the disclosure.

Figures 1, 1F:
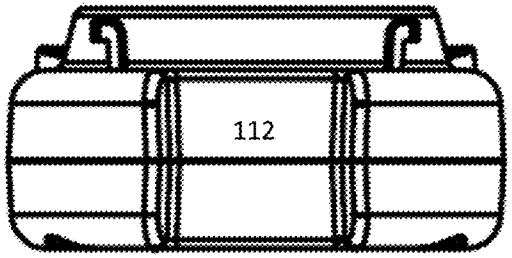
Figures 1, 1F, 2:
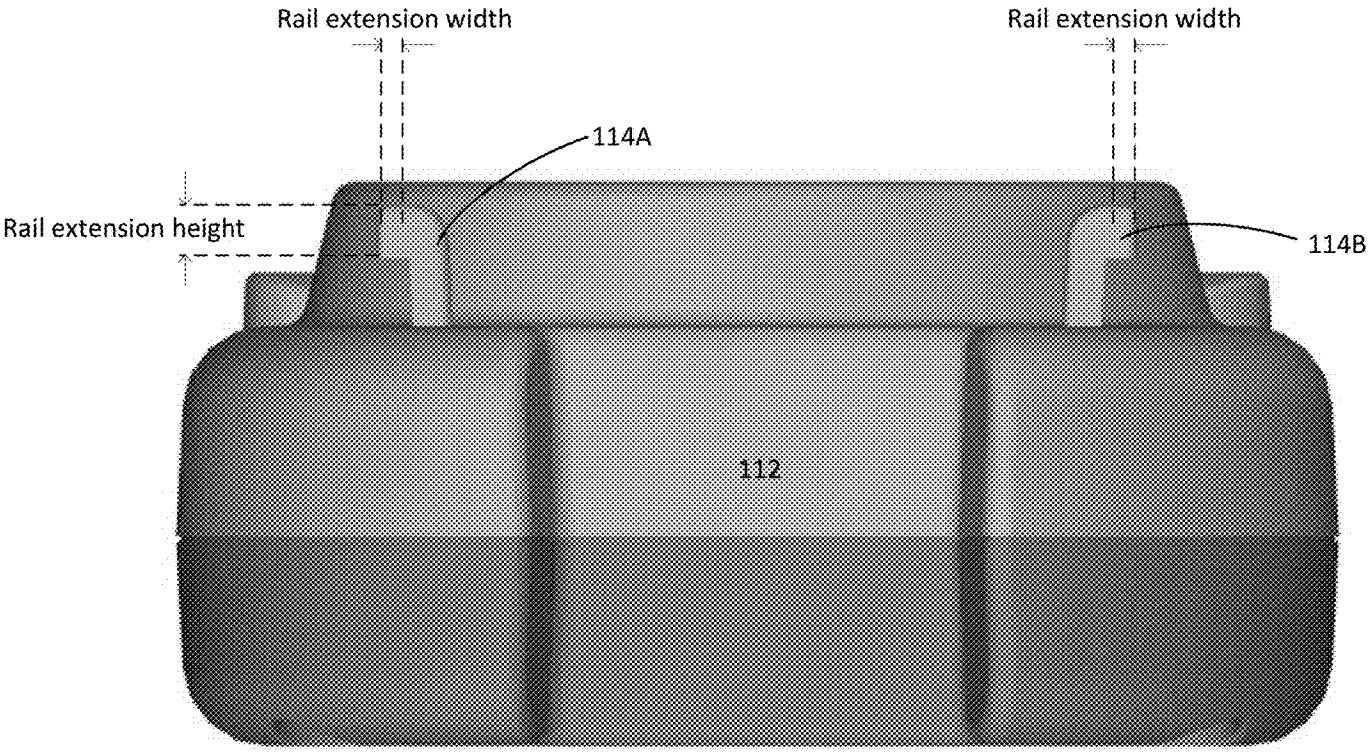

FIGS. 1F-1 and 1F-2 illustrate a back view of a travel adapter, in accordance with an aspect of the disclosure.

Figure 2A:
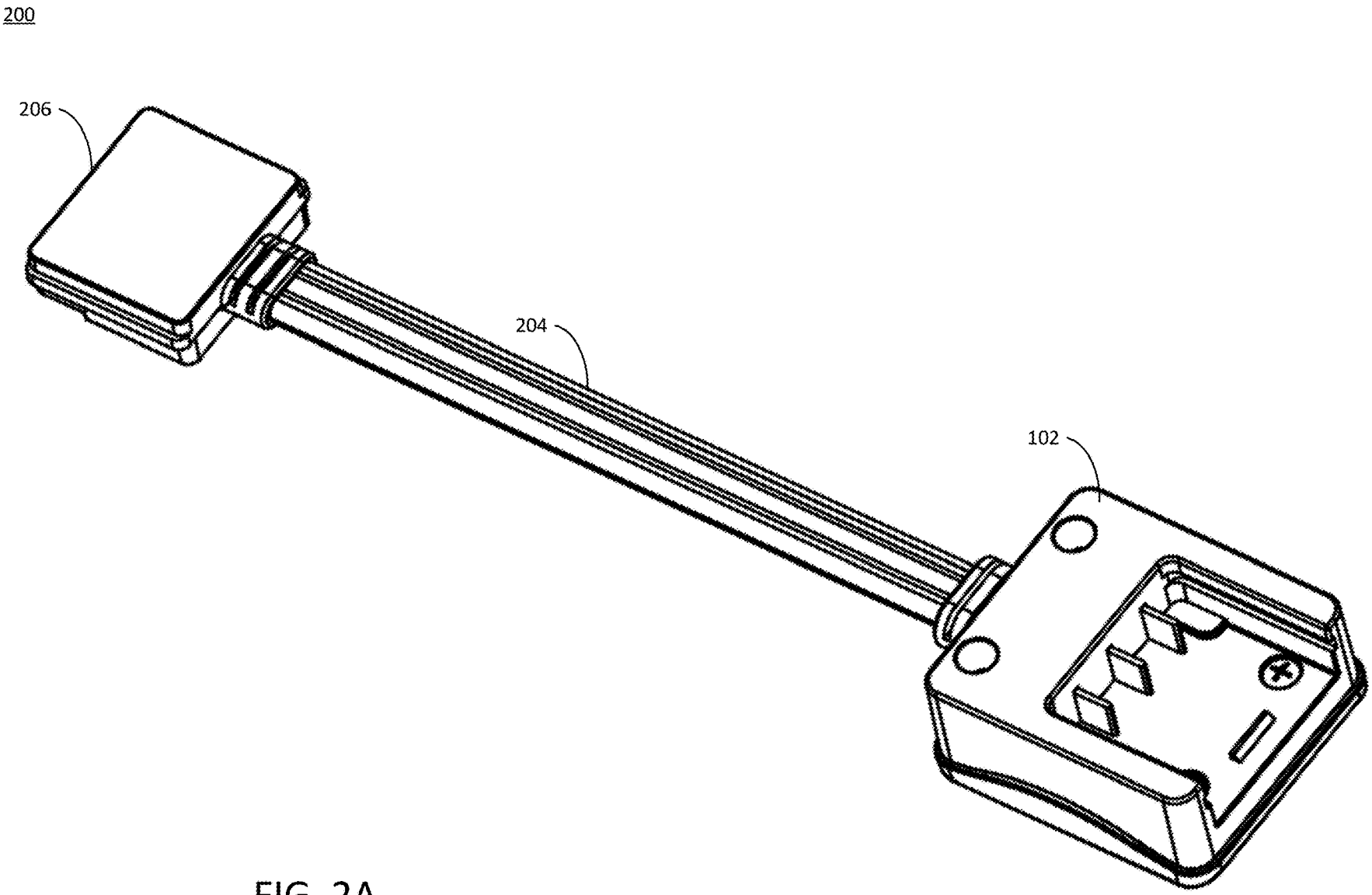

FIG. 2A illustrates a three-dimensional view of a travel adapter extension assembly, in accordance with an aspect of the disclosure.

Figure 2B:
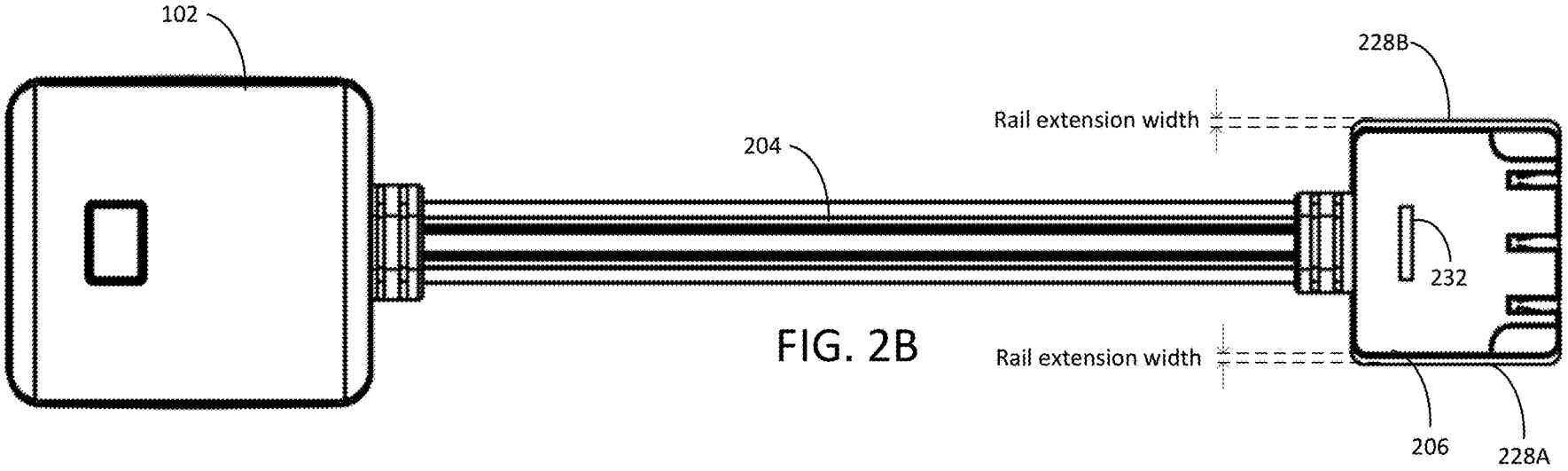

FIG. 2B illustrates a top view of a travel adapter extension assembly, in accordance with an aspect of the disclosure.

Figure 2C:
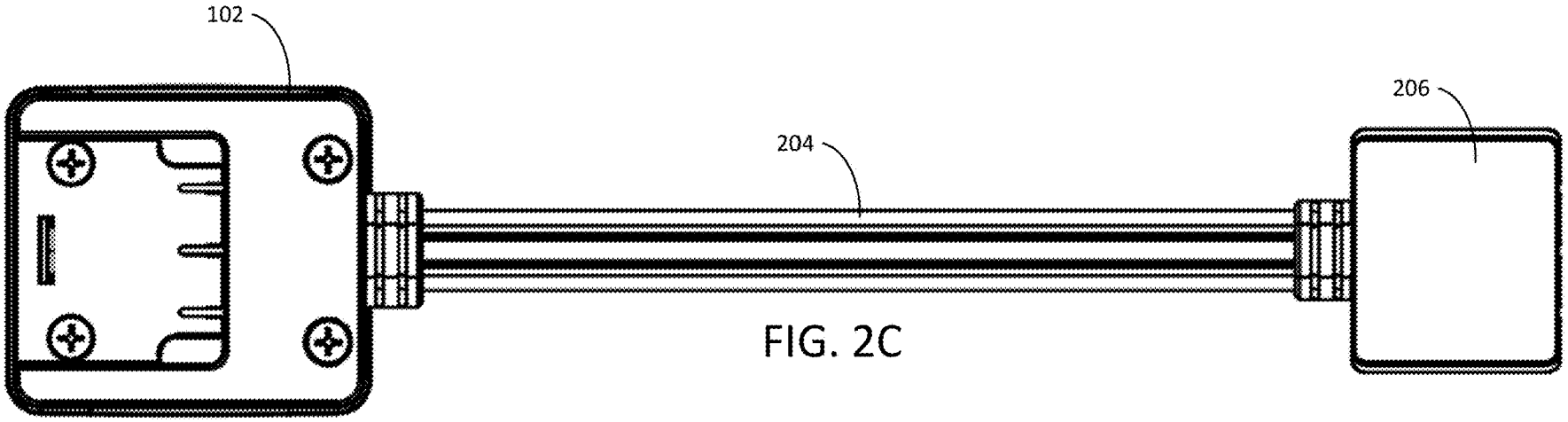

FIG. 2C illustrates a bottom view of a travel adapter extension assembly, in accordance with an aspect of the disclosure.

Figure 2D:
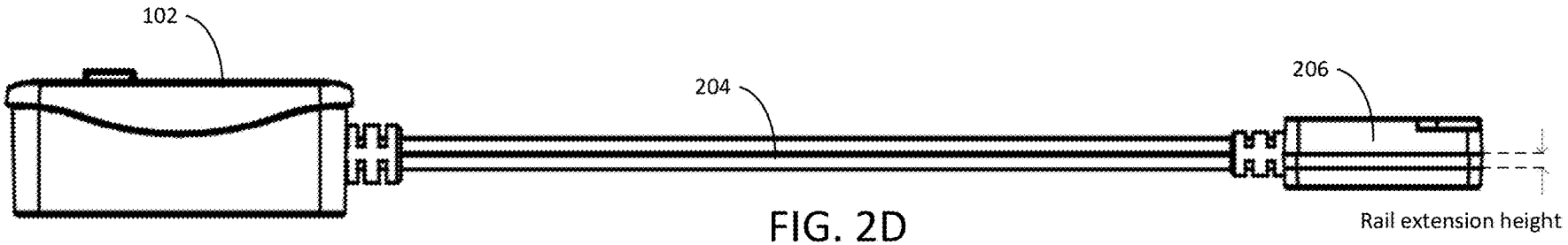

FIG. 2D illustrates a side view of a travel adapter extension assembly, in accordance with an aspect of the disclosure.

Figure 2E:
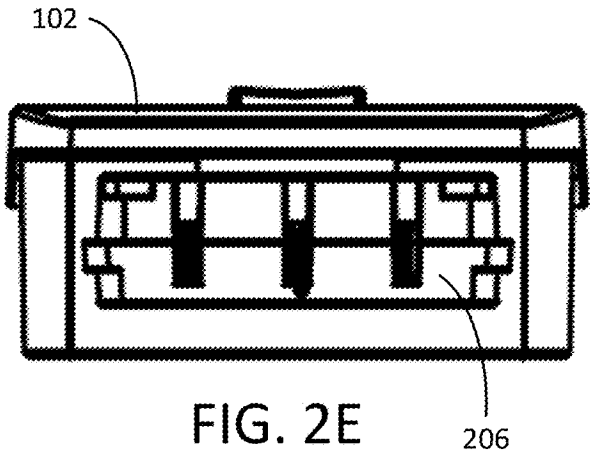

FIG. 2E illustrates a front view of a travel adapter extension assembly, in accordance with an aspect of the disclosure.

Figure 2F:
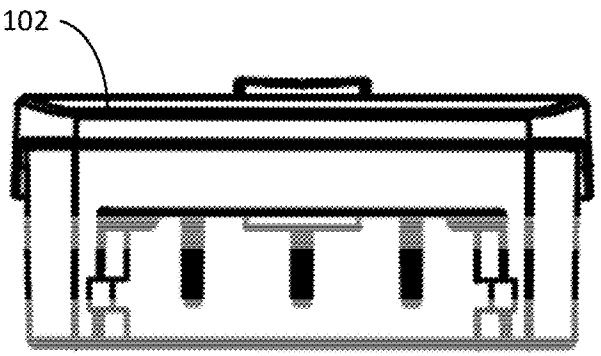

FIG. 2F illustrates a back view of a travel adapter extension assembly, in accordance with an aspect of the disclosure.

Figure 3:
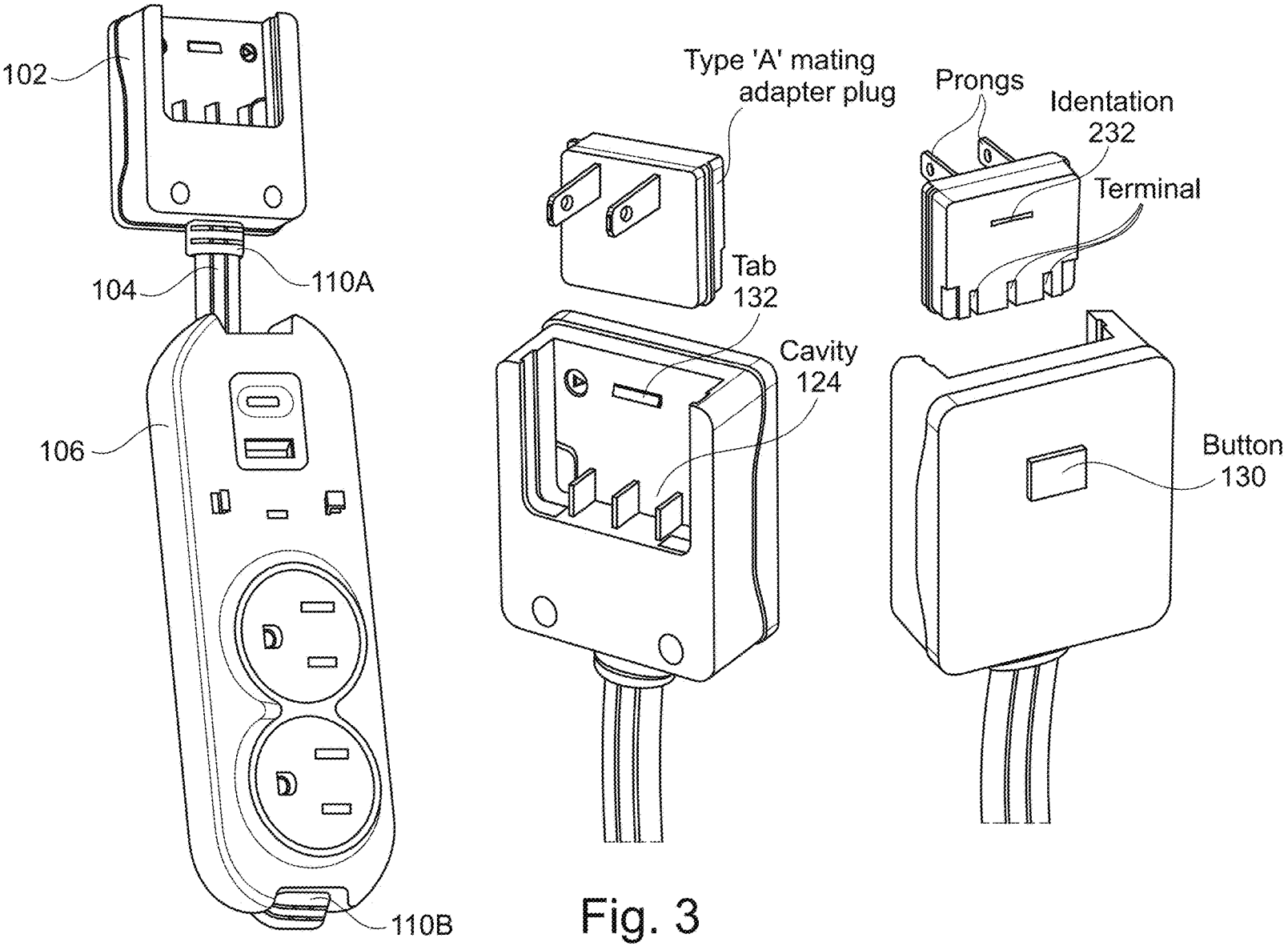

FIG. 3 is an image of the travel adapter as shown in FIG. 1A with the plug adapter assembly removed from the main housing 106, shown with an accompanying type A mating adapter plug, in accordance with an aspect of the disclosure.

Figure 4:
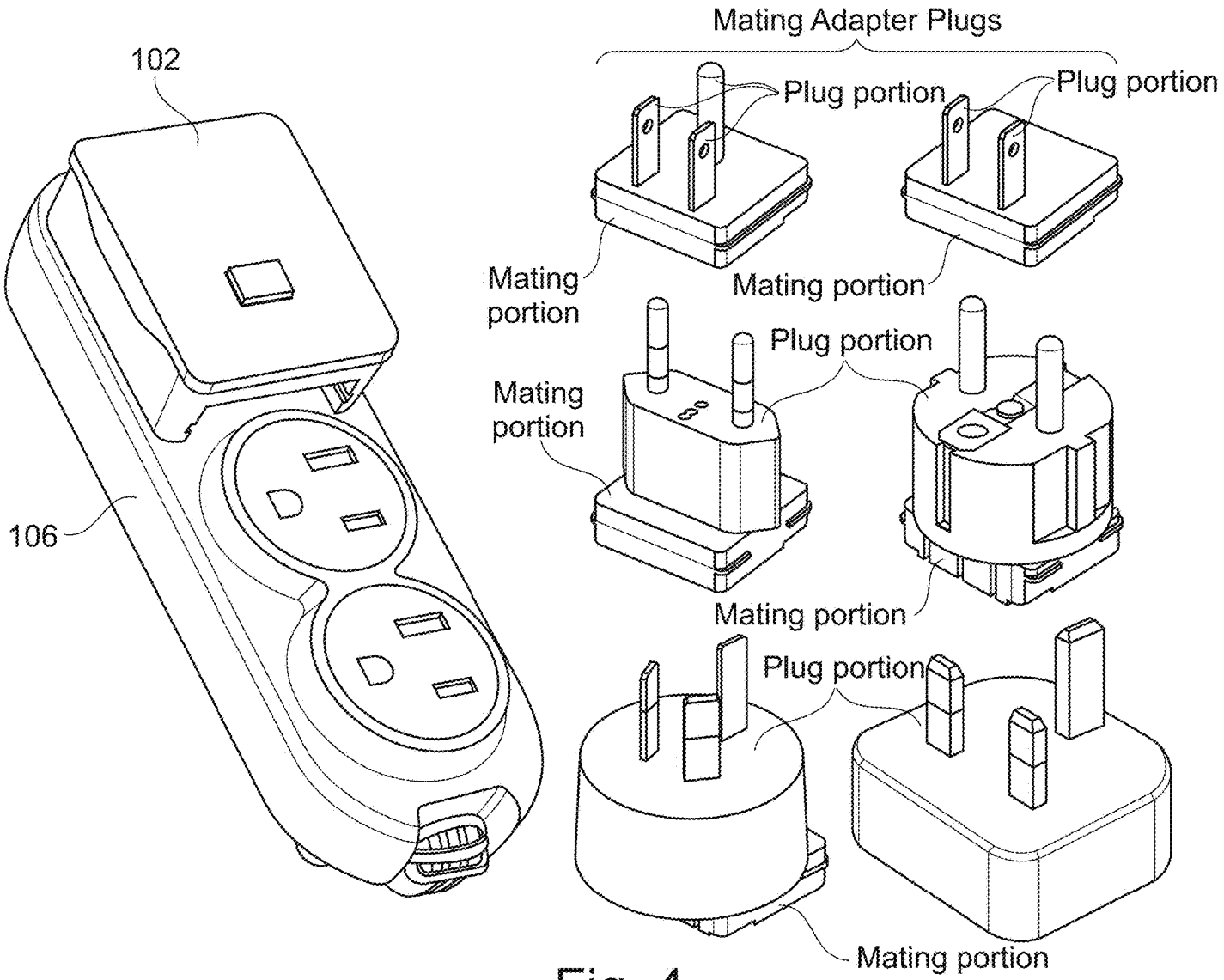

FIG. 4 is an image of the travel adapter as shown in FIGS. 1A-1F in the closed position with accompanying type A, type B, type C, type E/F, type G, and type I mating adapter plugs, in accordance with an aspect of the disclosure.

Figure 5:
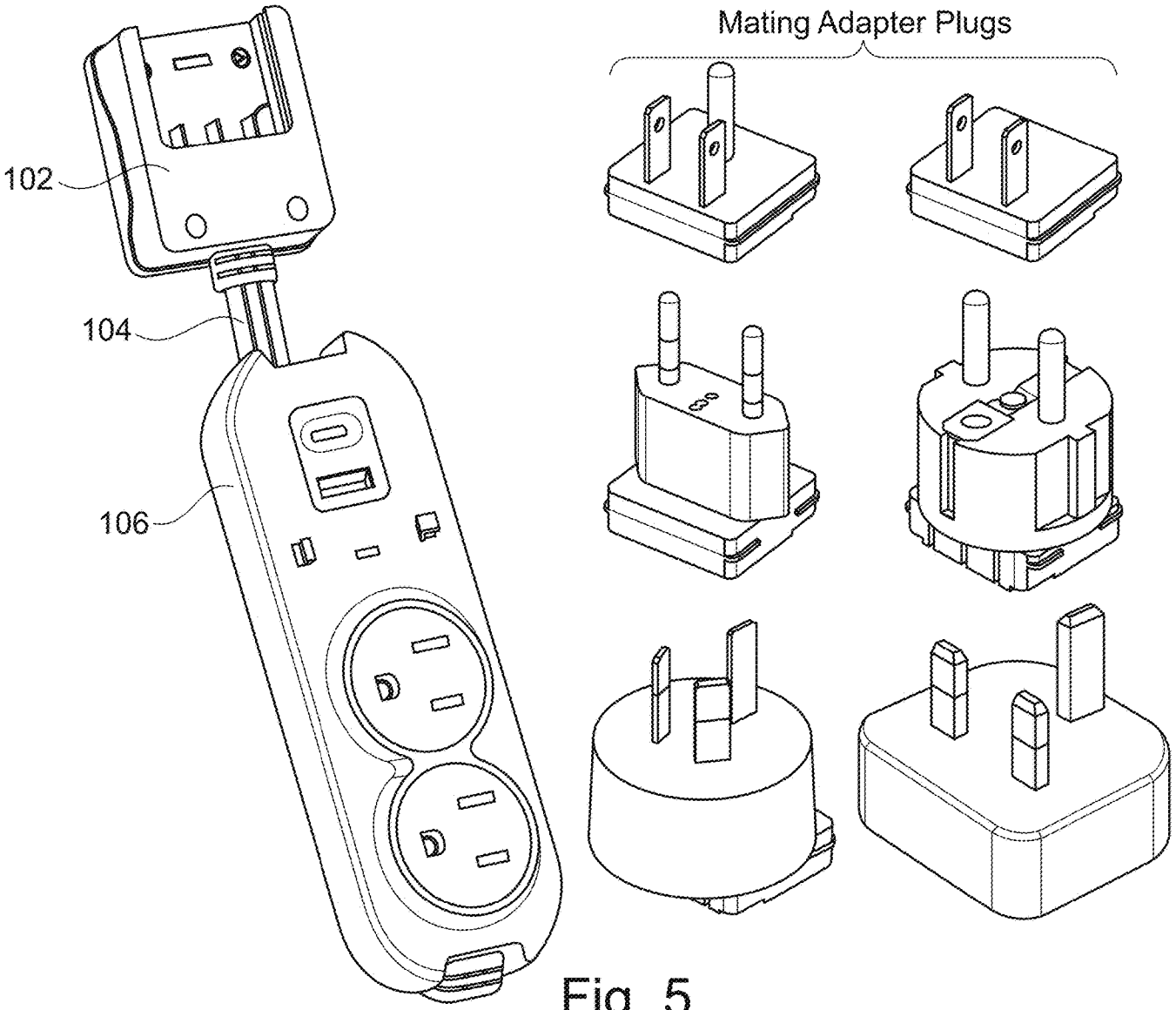

FIG. 5 is an image of the travel adapter as shown in FIG. 1A with the plug adapter assembly removed from the main housing 106, with accompanying type A, type B, type C, type E/F, type G, and type I mating adapter plugs, in accordance with an aspect of the disclosure.

Figure 6A:
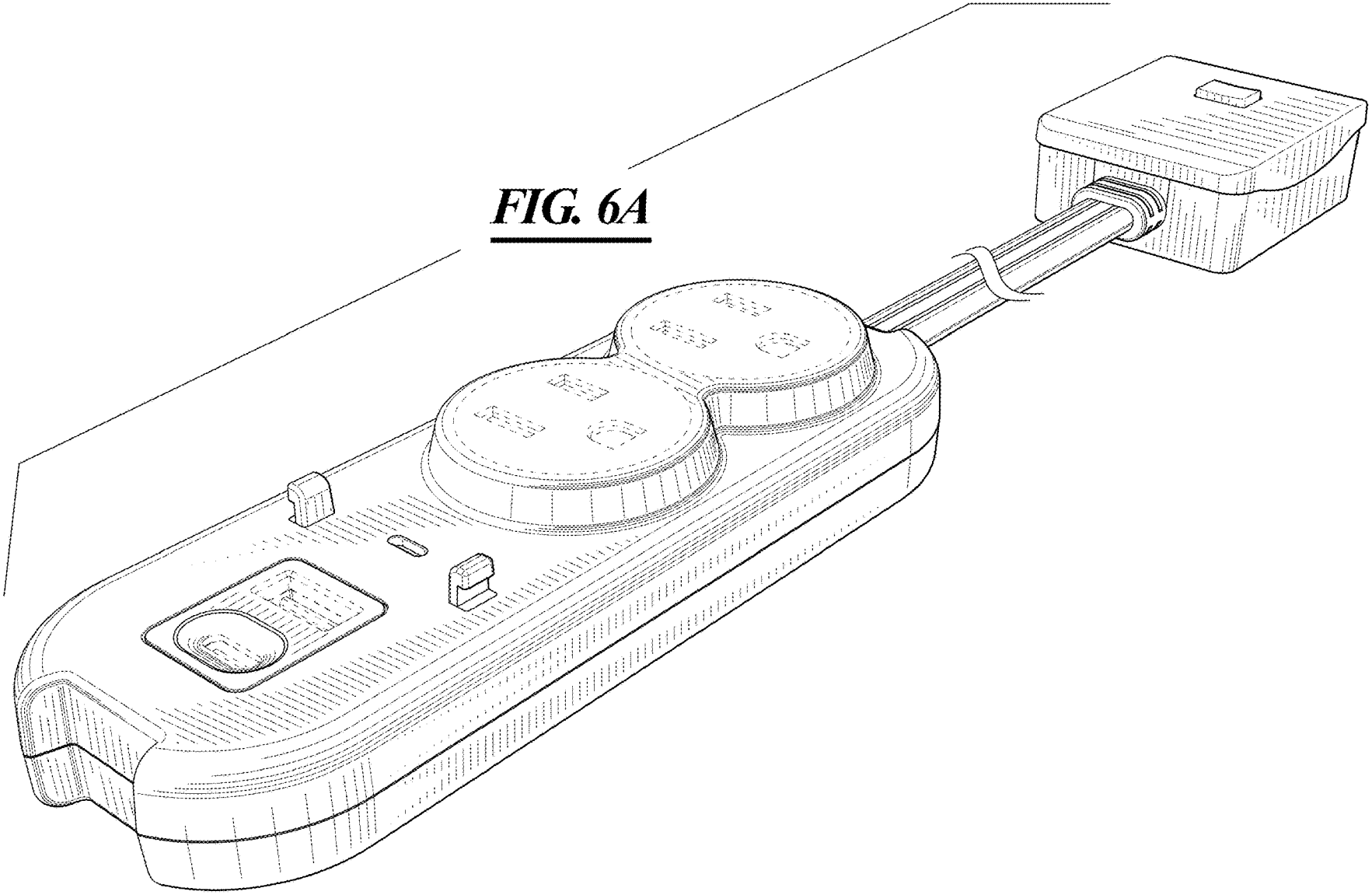
Figure 6B:
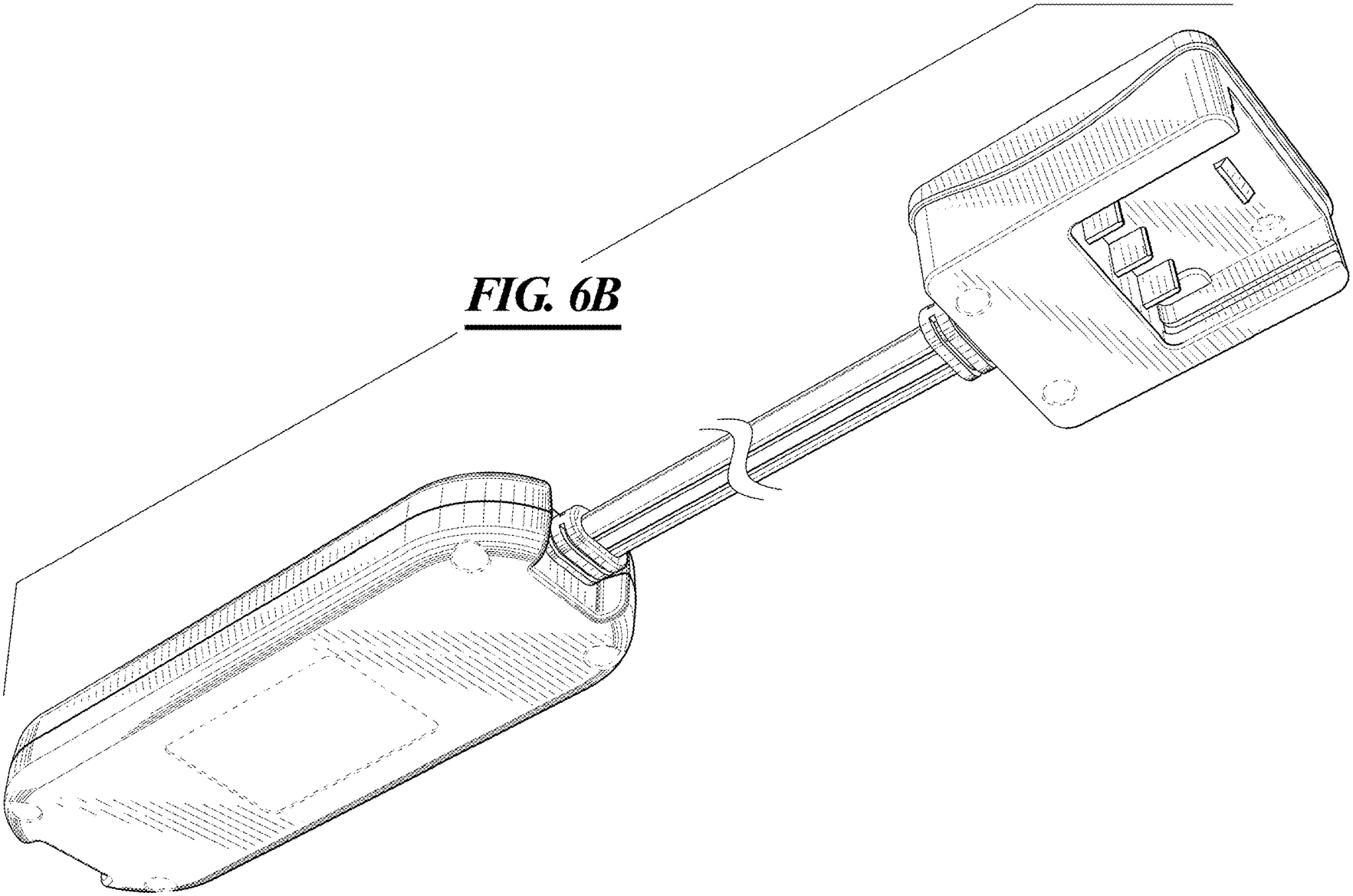
Figure 6C:
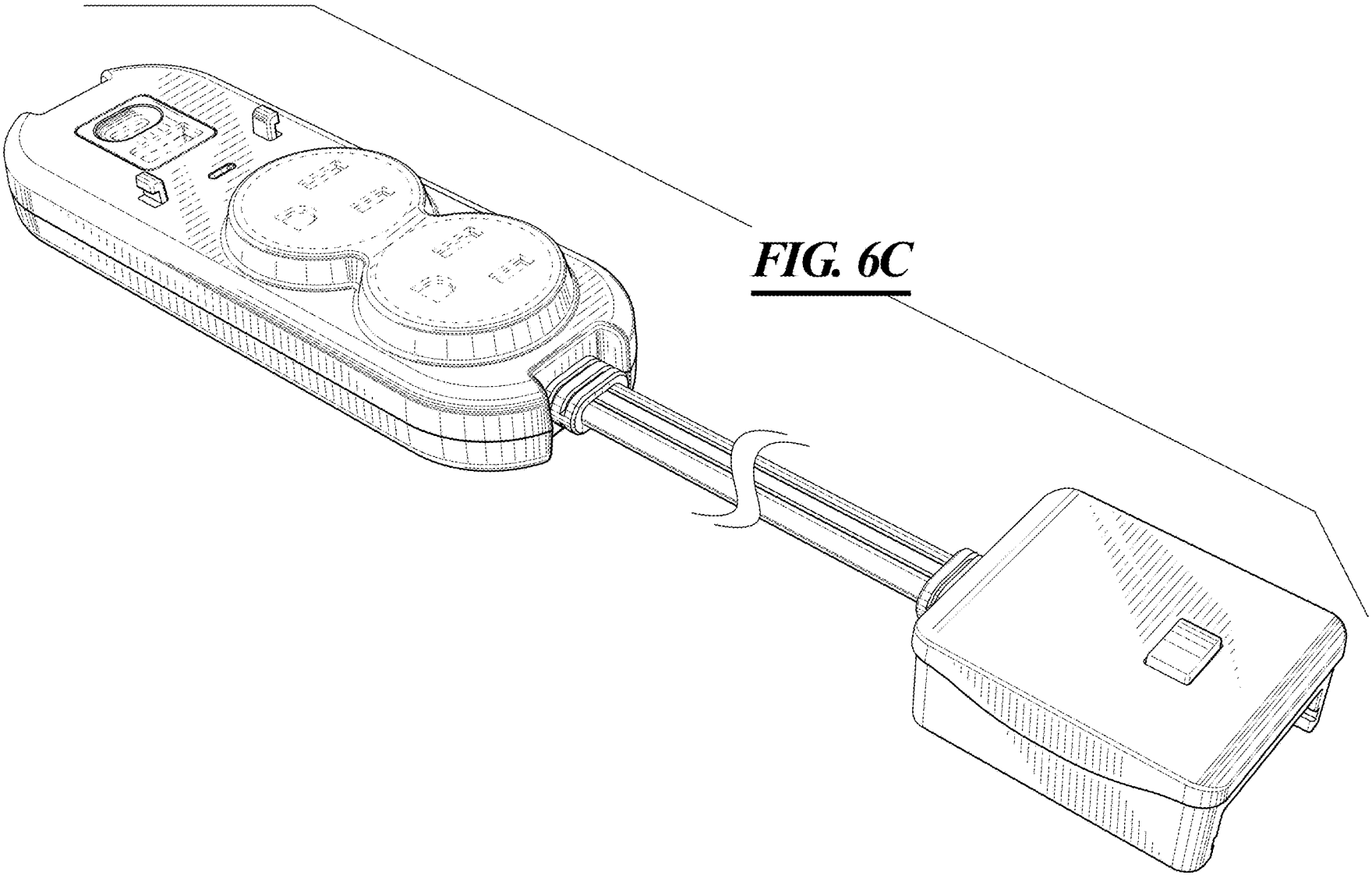
Figure 6D:
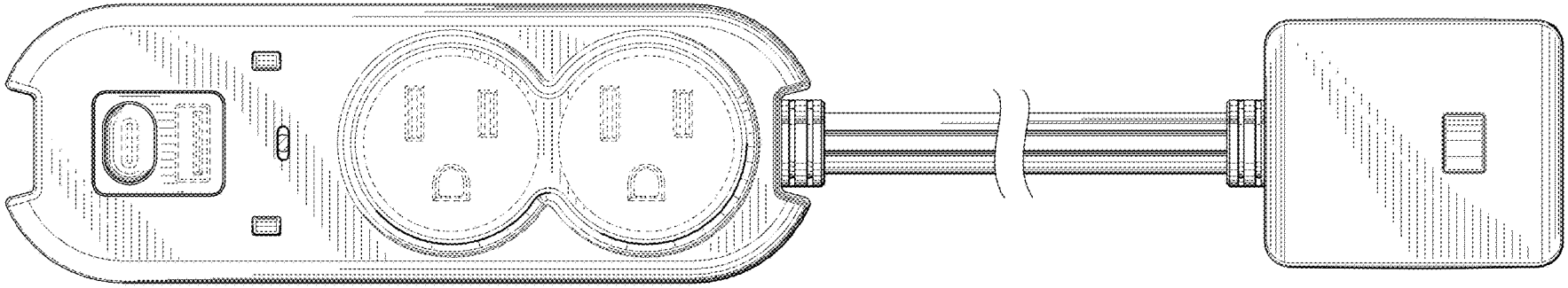
Figure 6E:
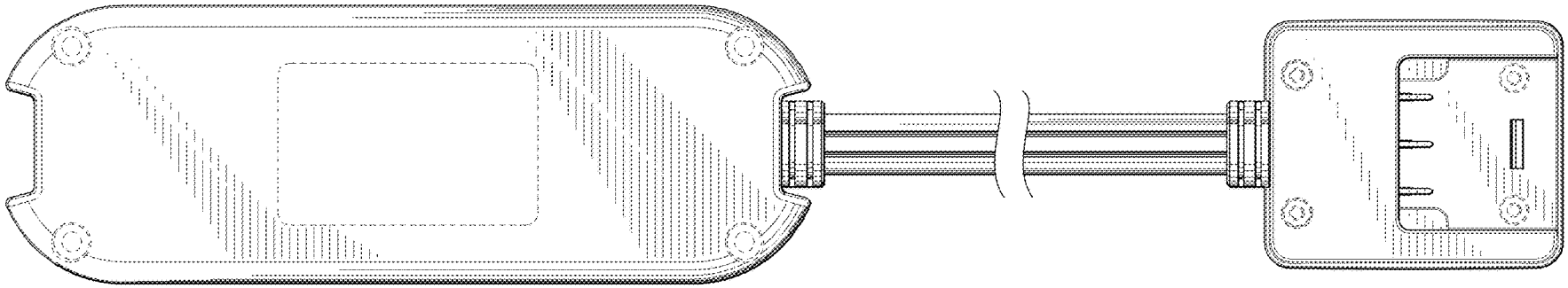
Figure 6F:
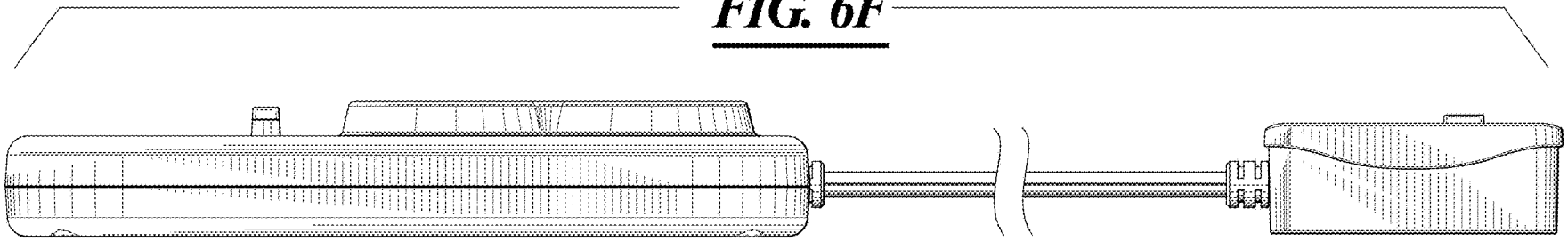
Figure 6G:
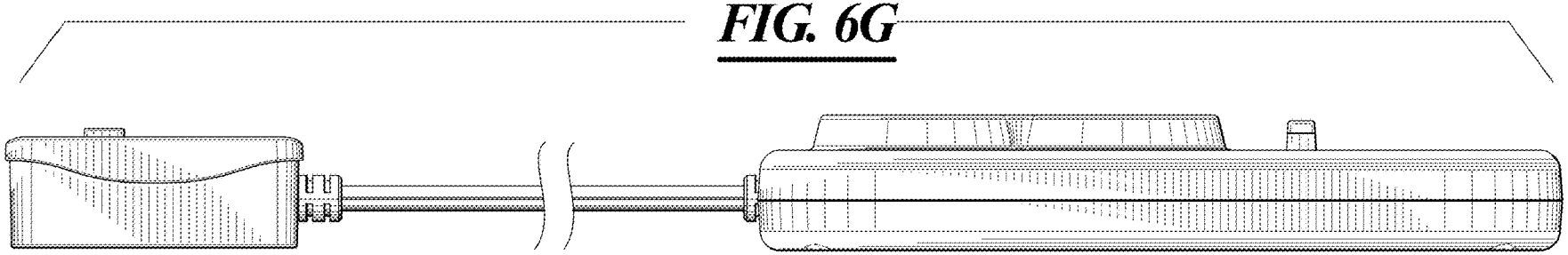
Figure 6I:
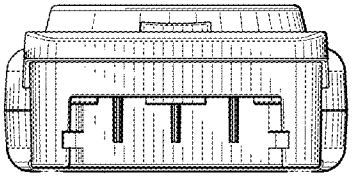
Figure 6H:
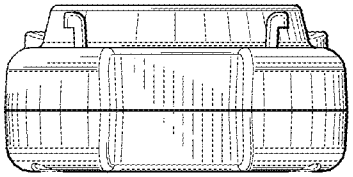
Figure 6J:
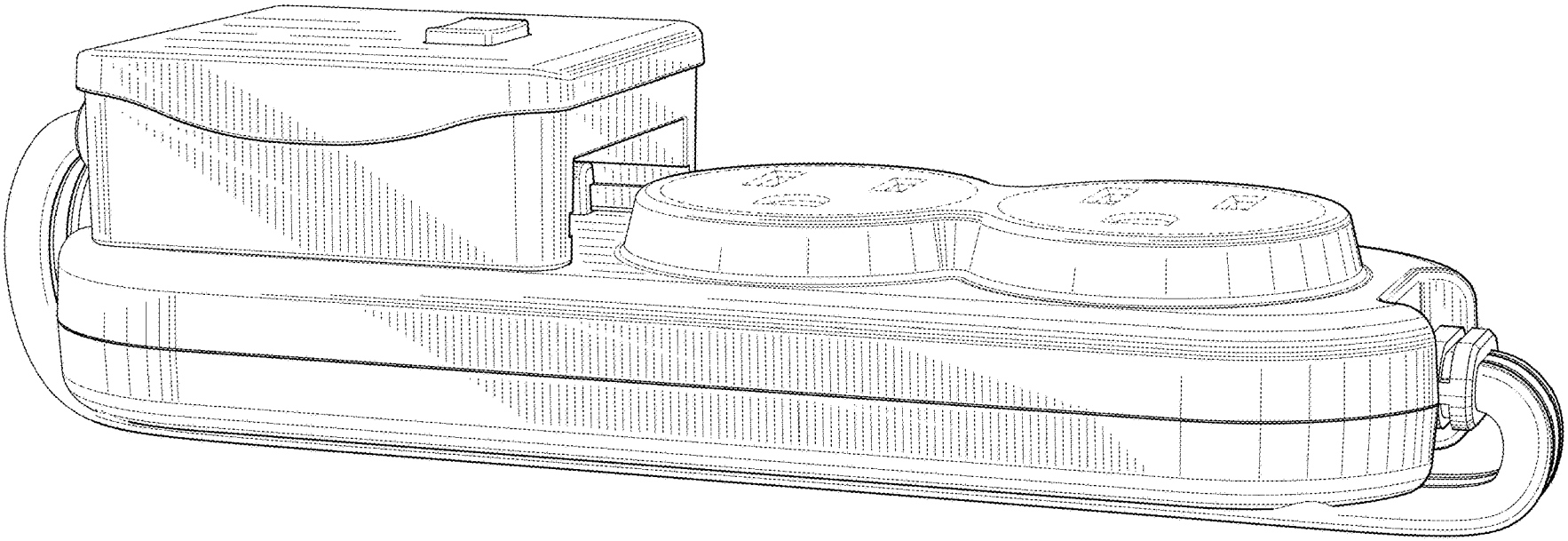
Figure 6K:
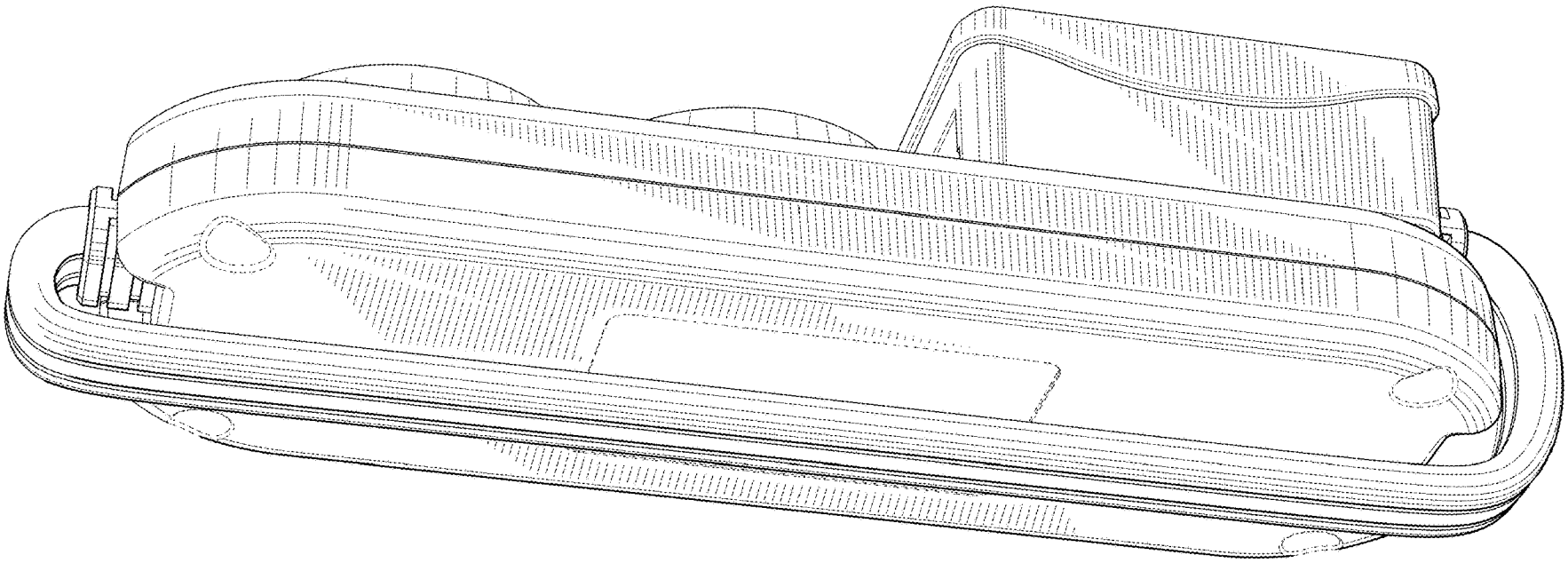
Figure 6L:
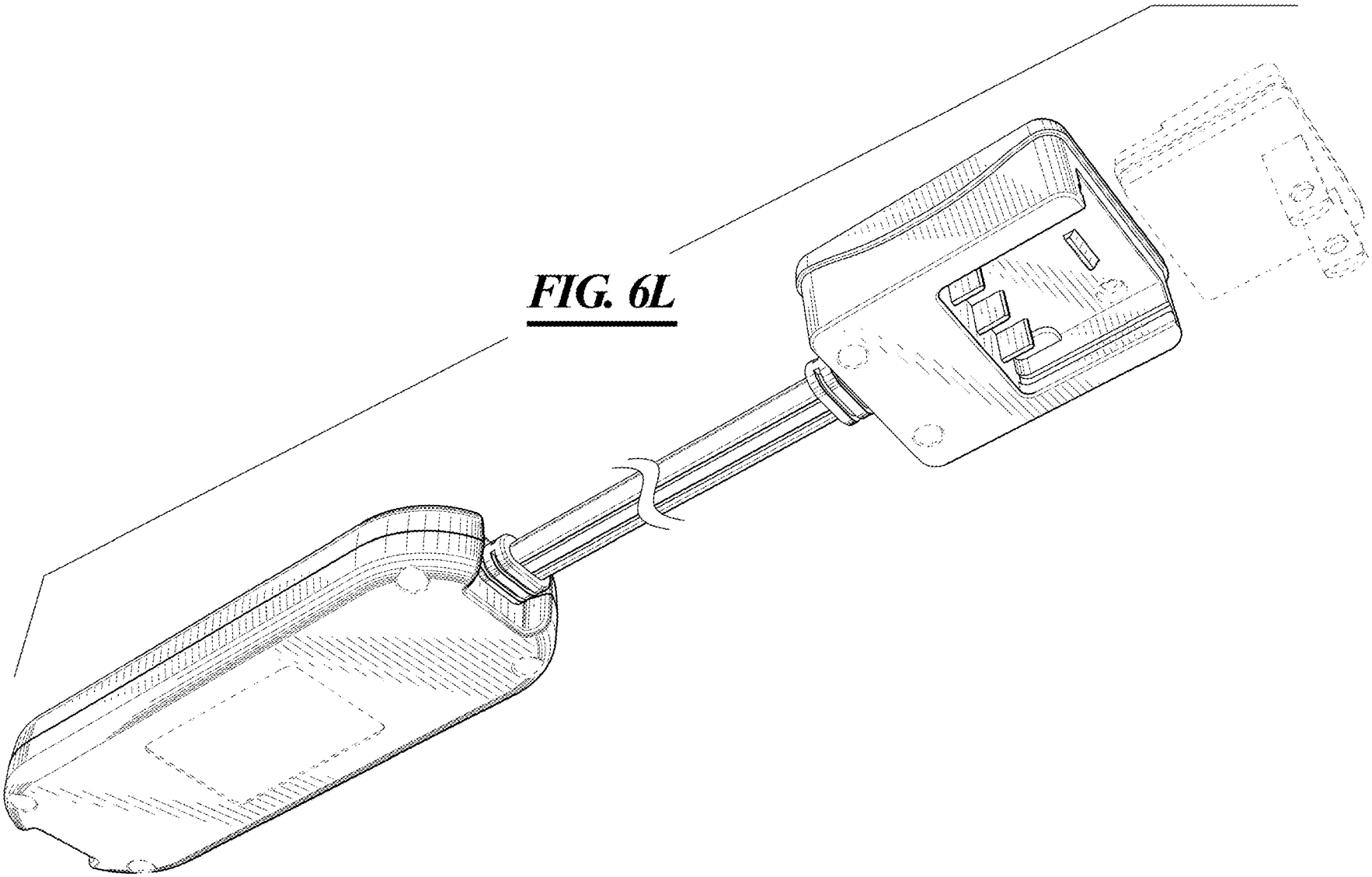
Figure 6M:
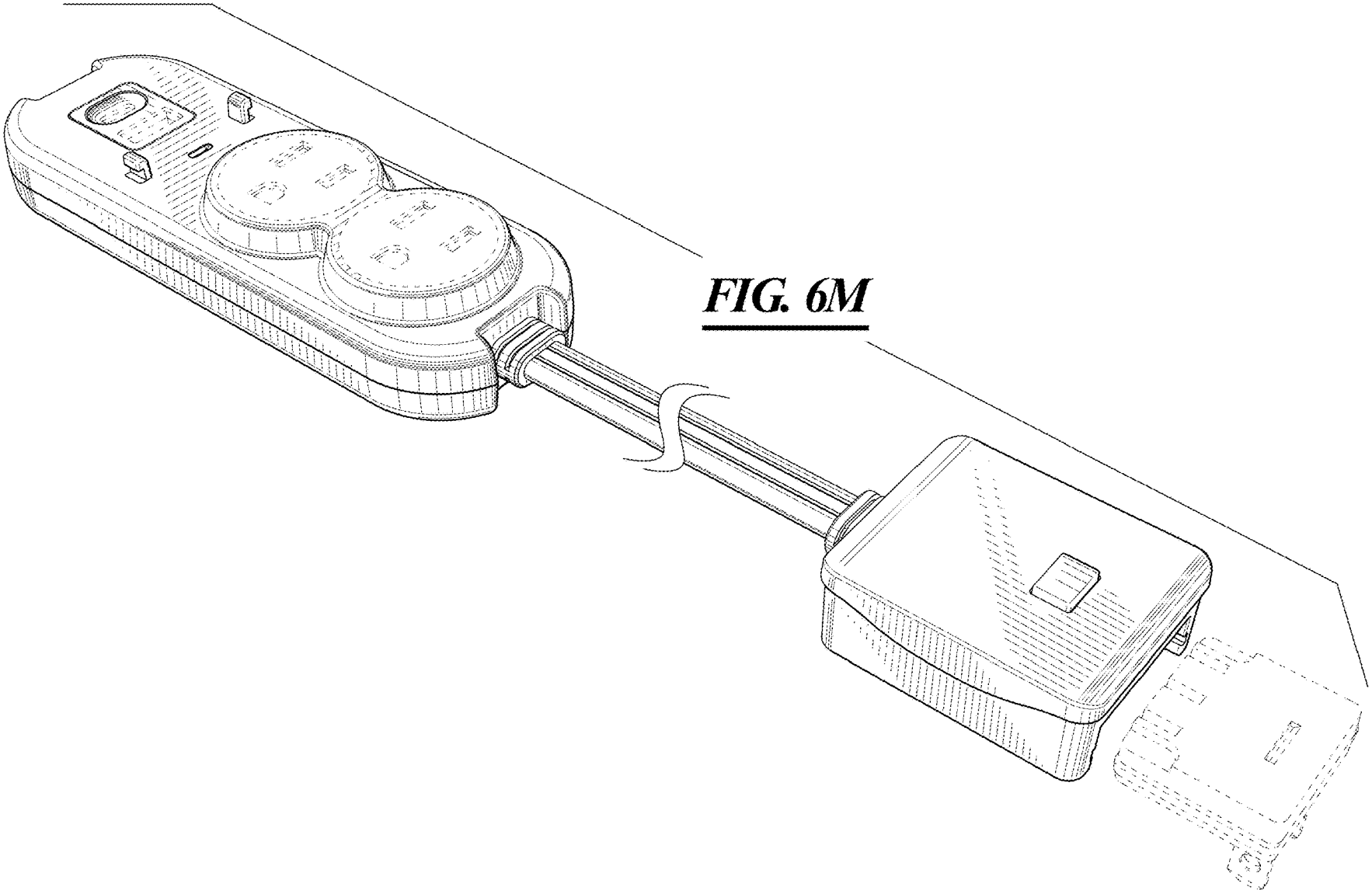
Figure 6N:
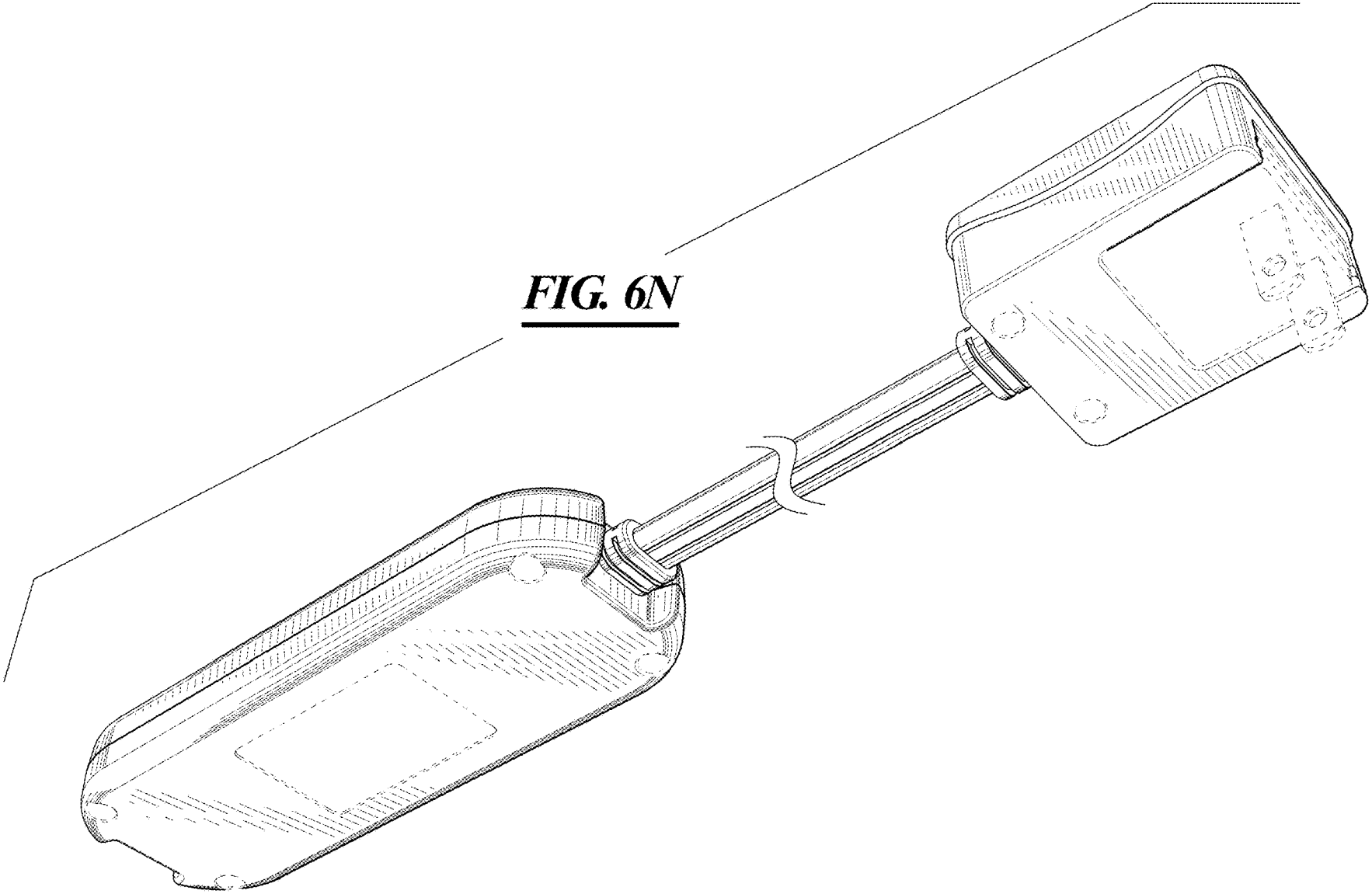
Figure 6O:
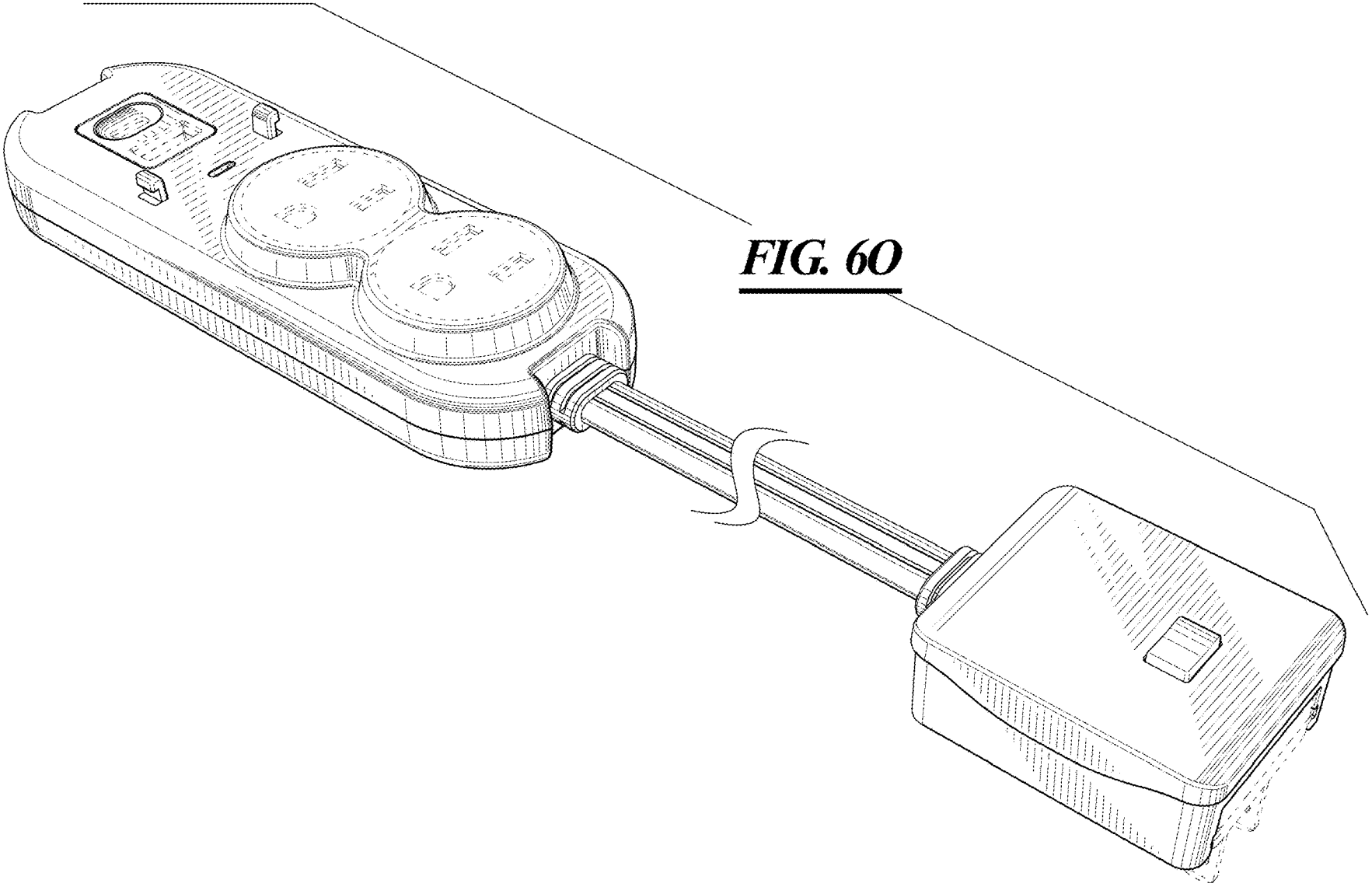
Figure 6P:
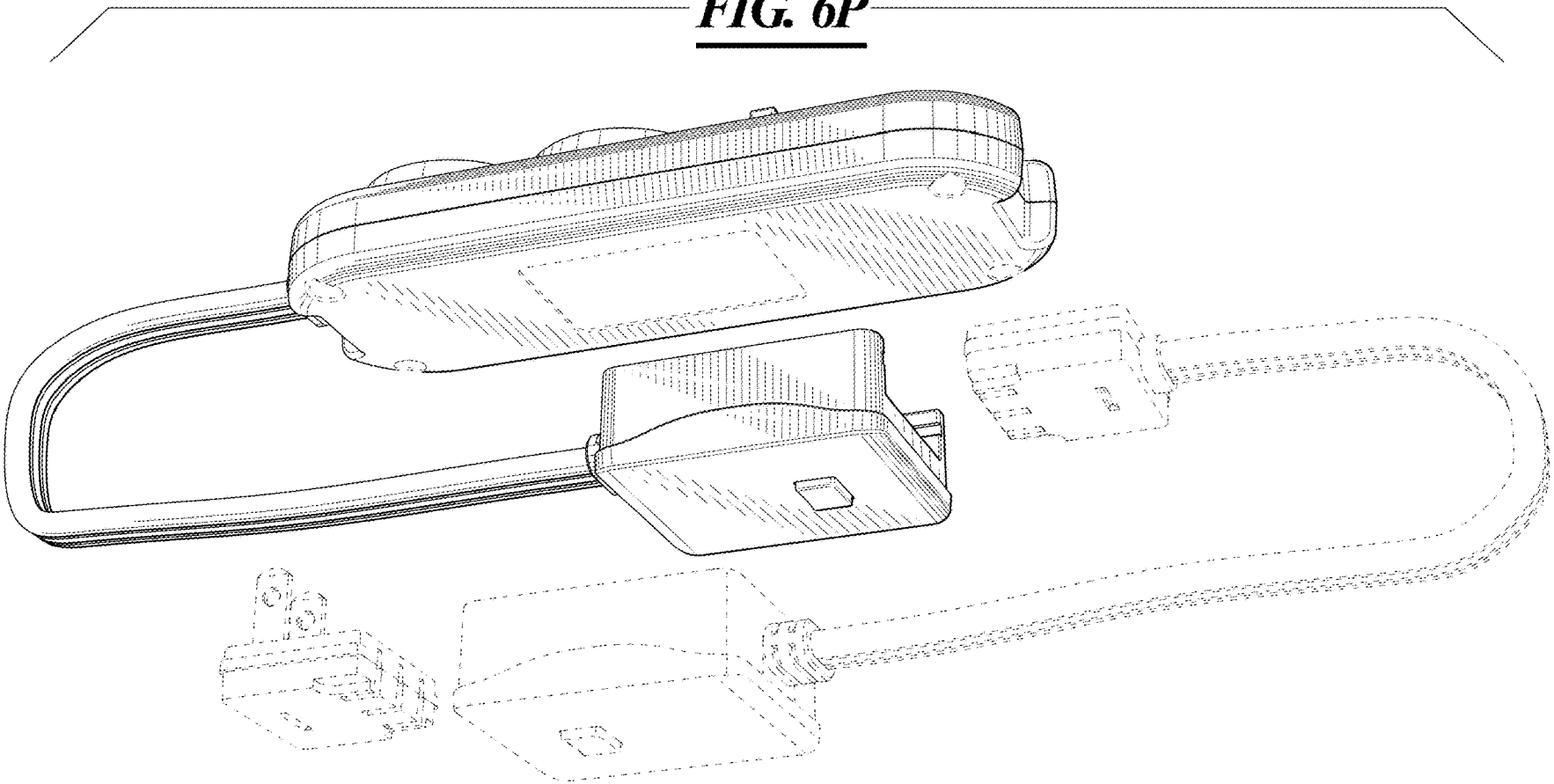
Figure 6Q:
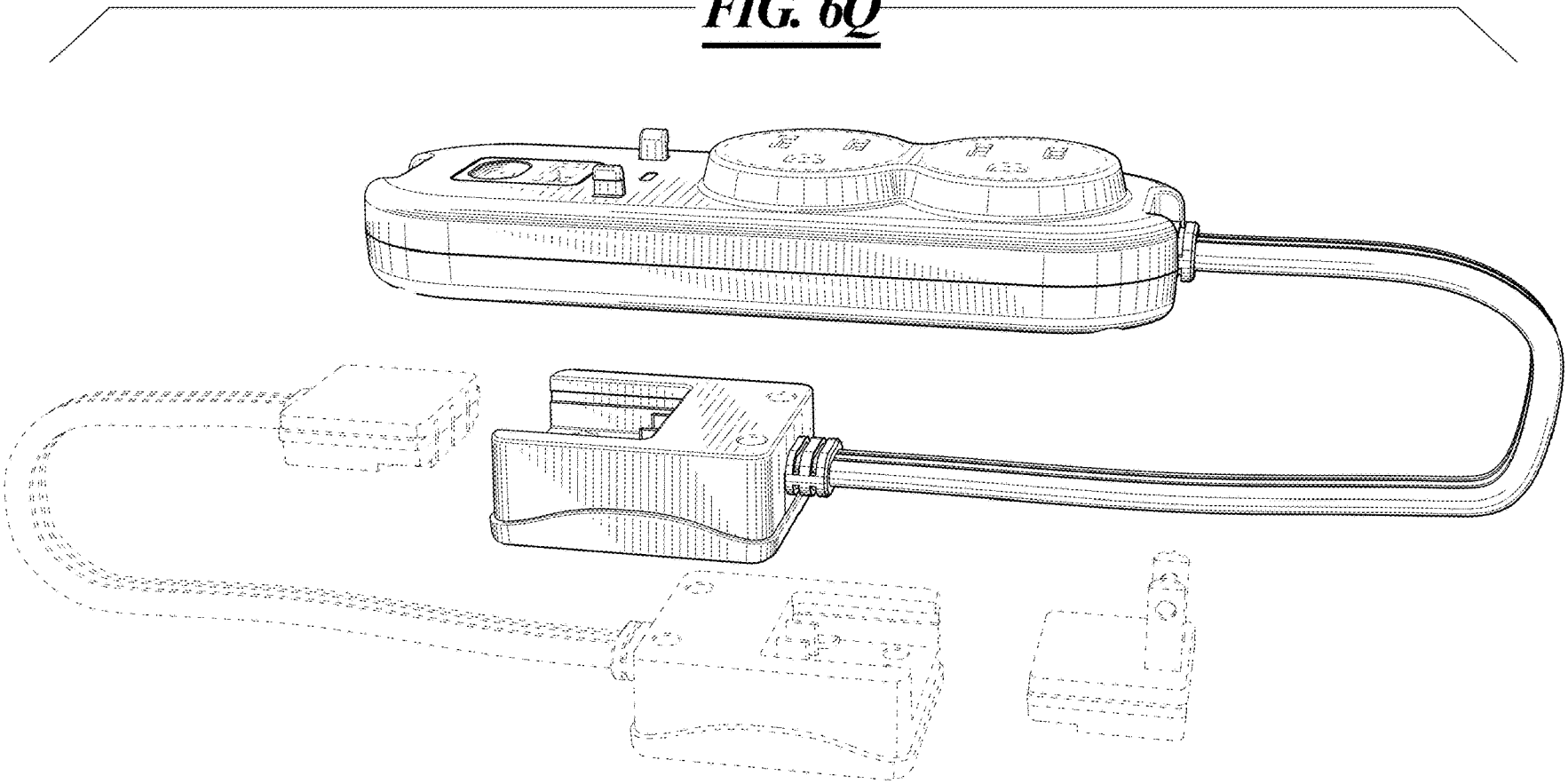
Figure 6R:
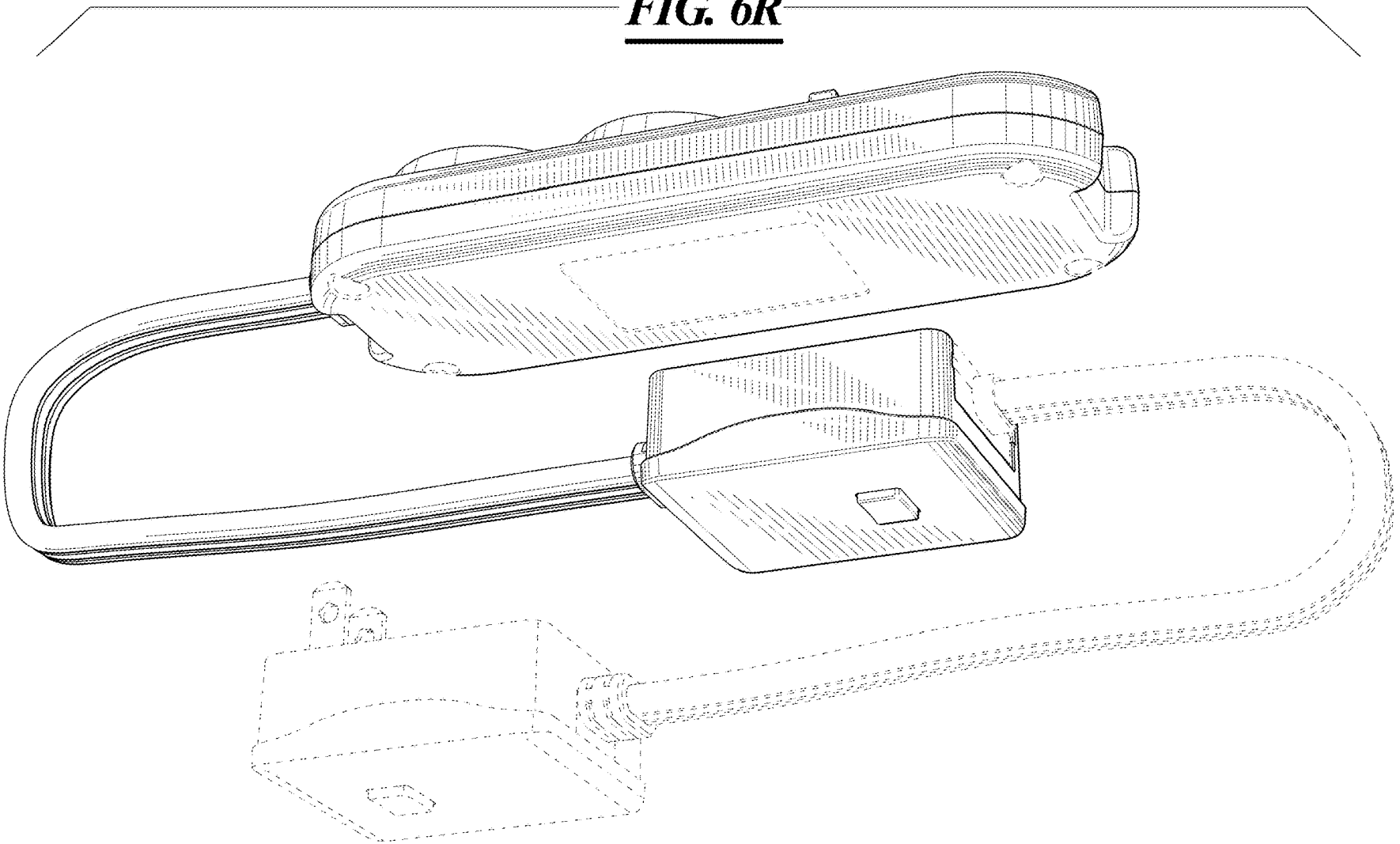
Figure 6S:
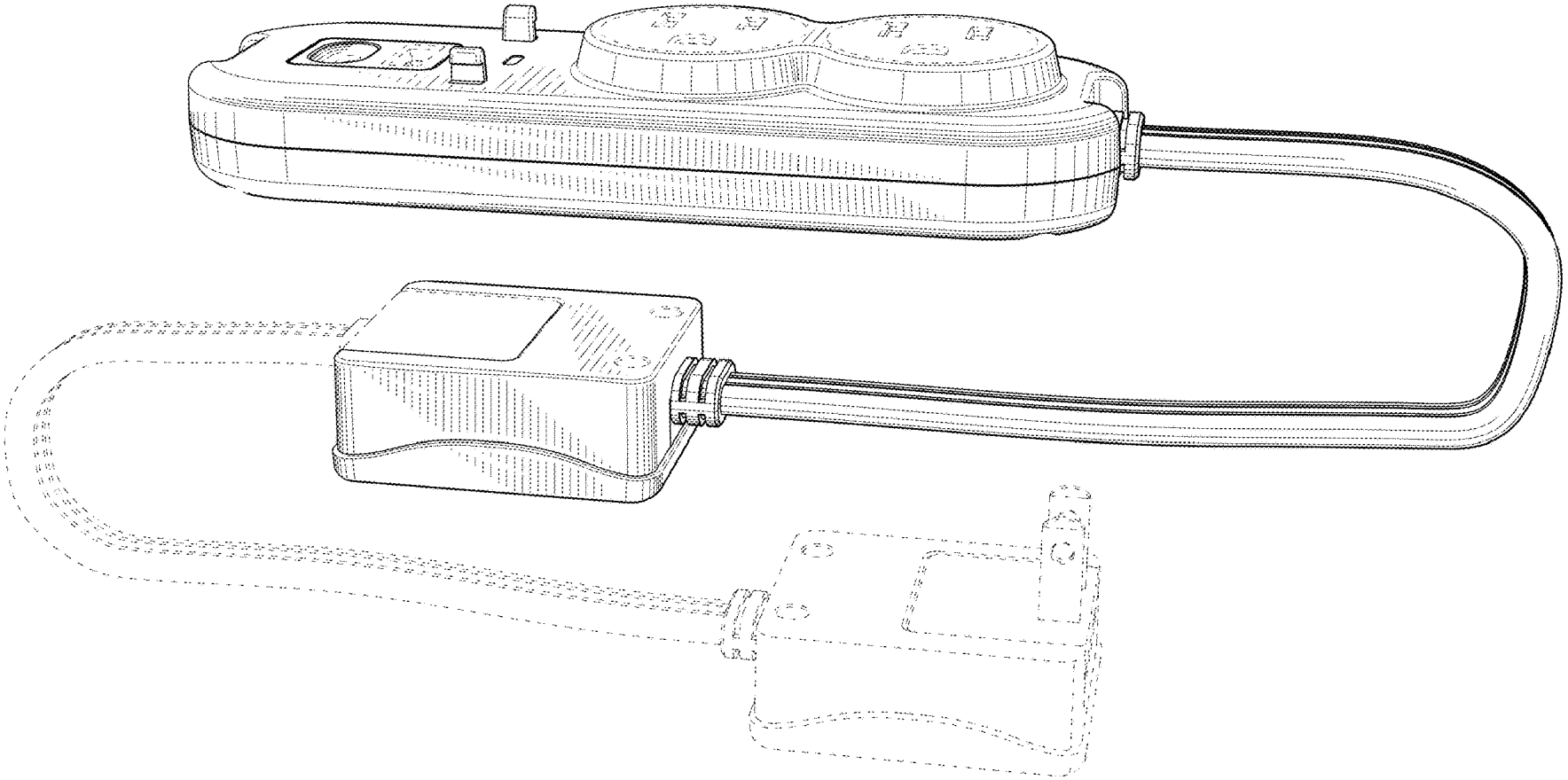
Figure 6T:
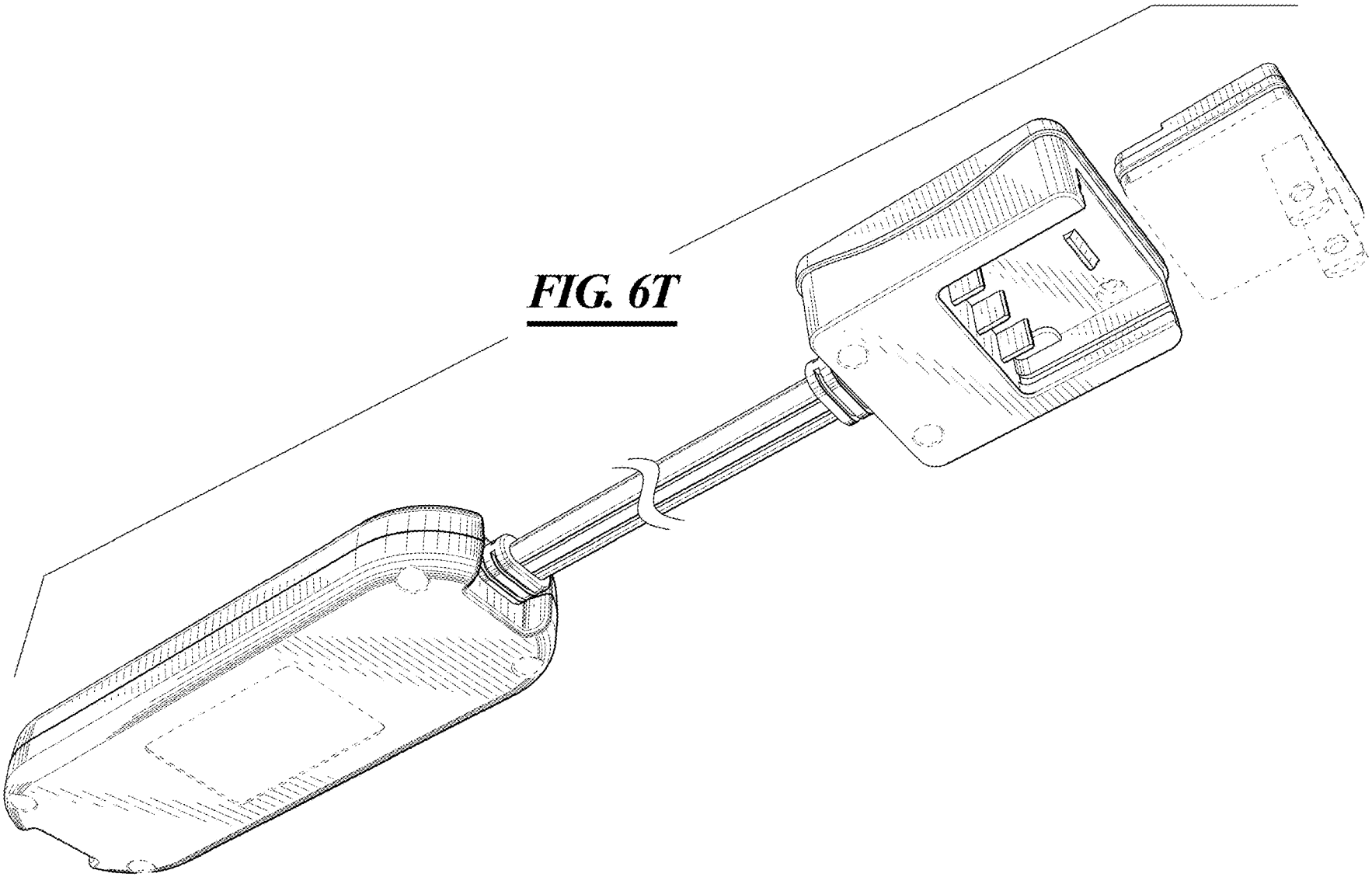
Figure 6U:
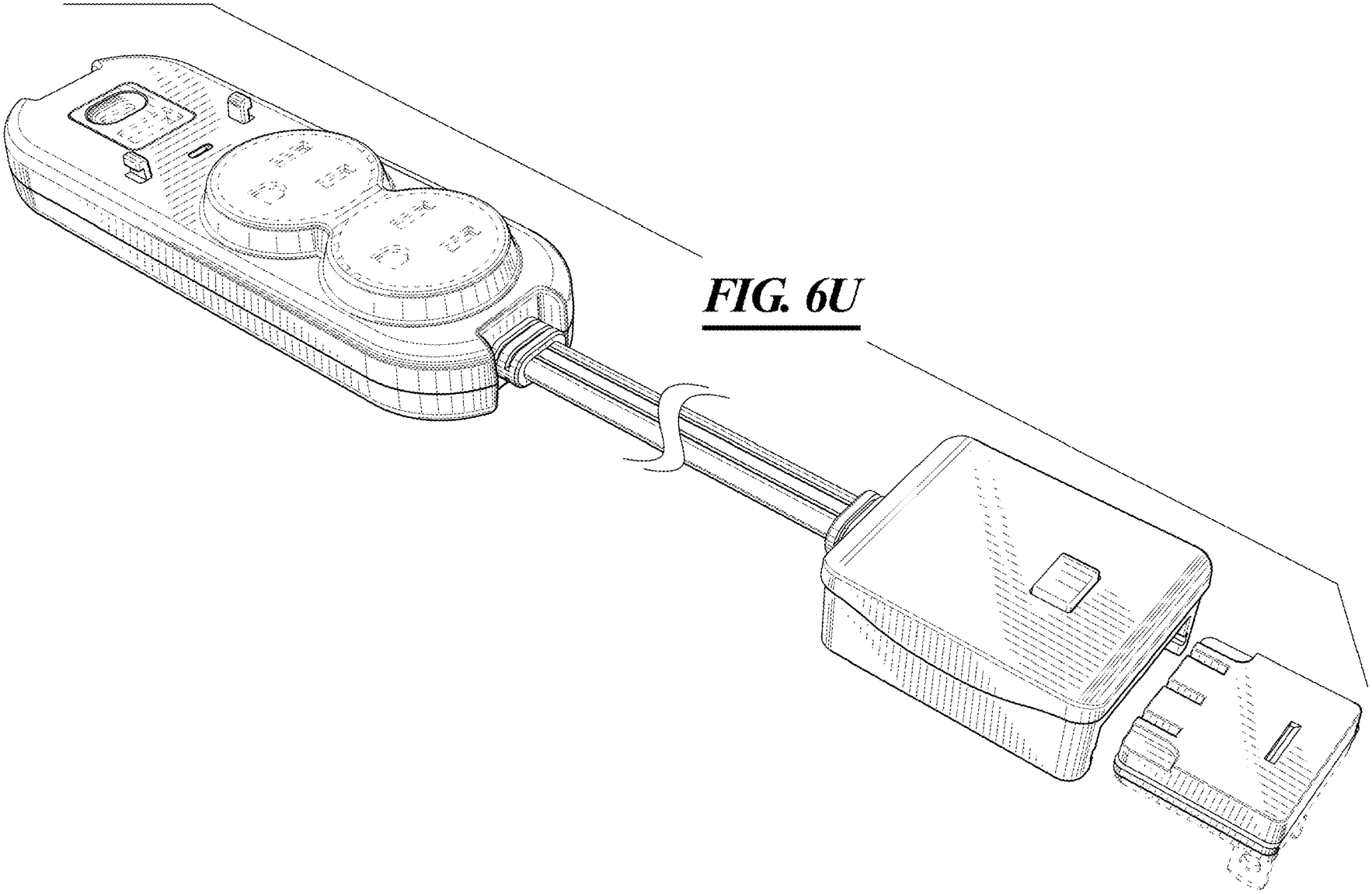
Figure 6V:
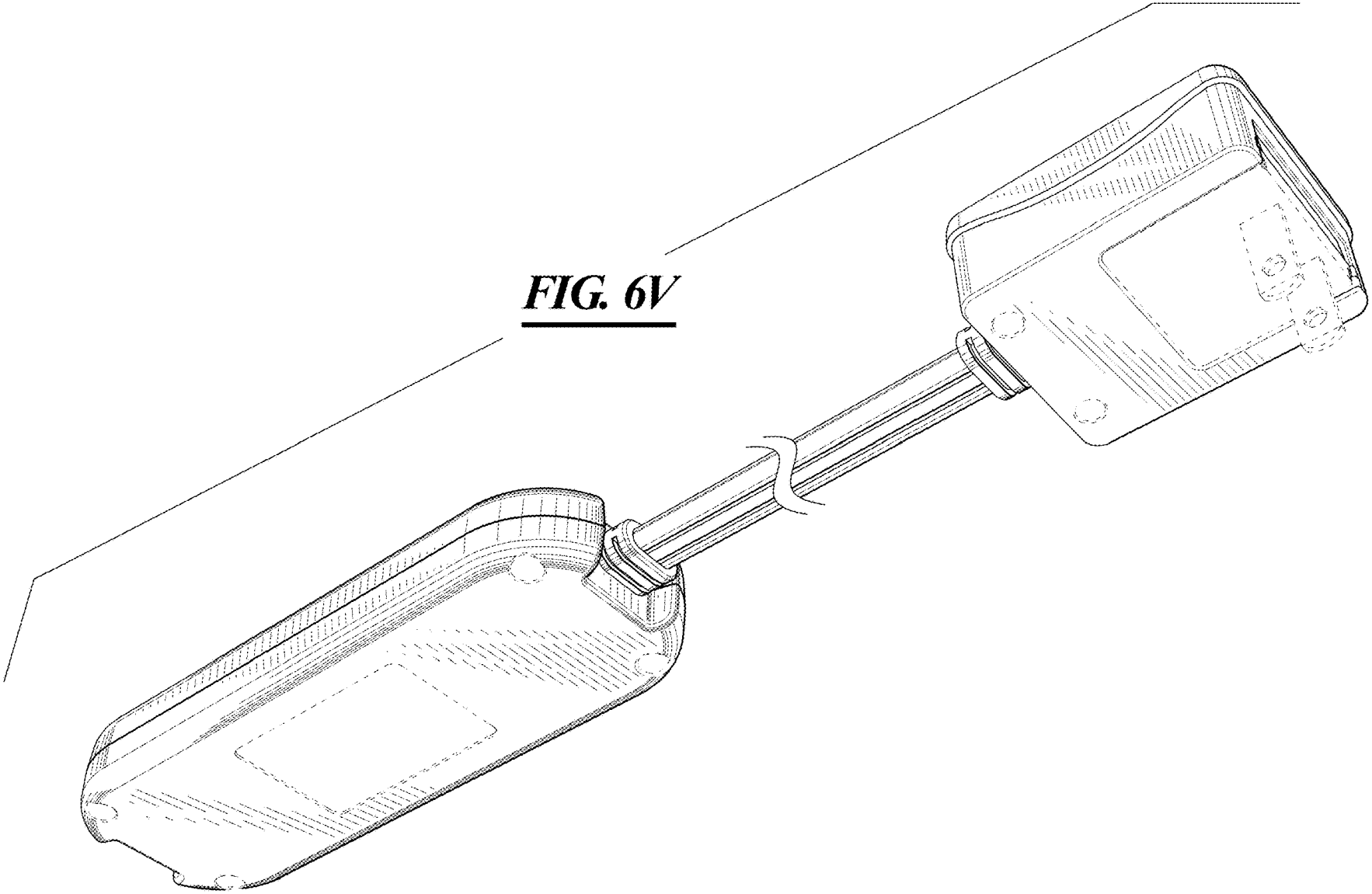
Figure 6W:
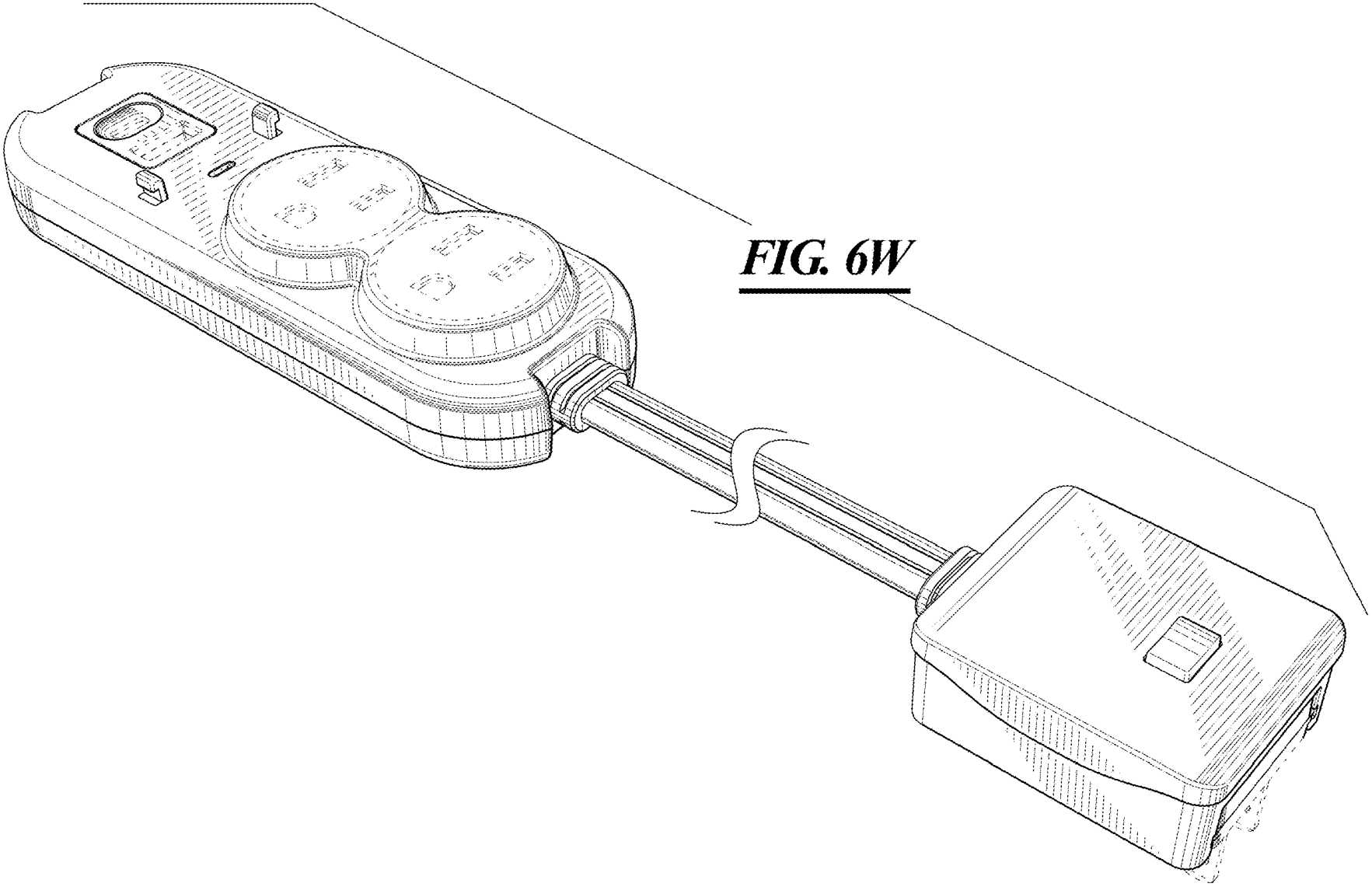
Figure 6X:
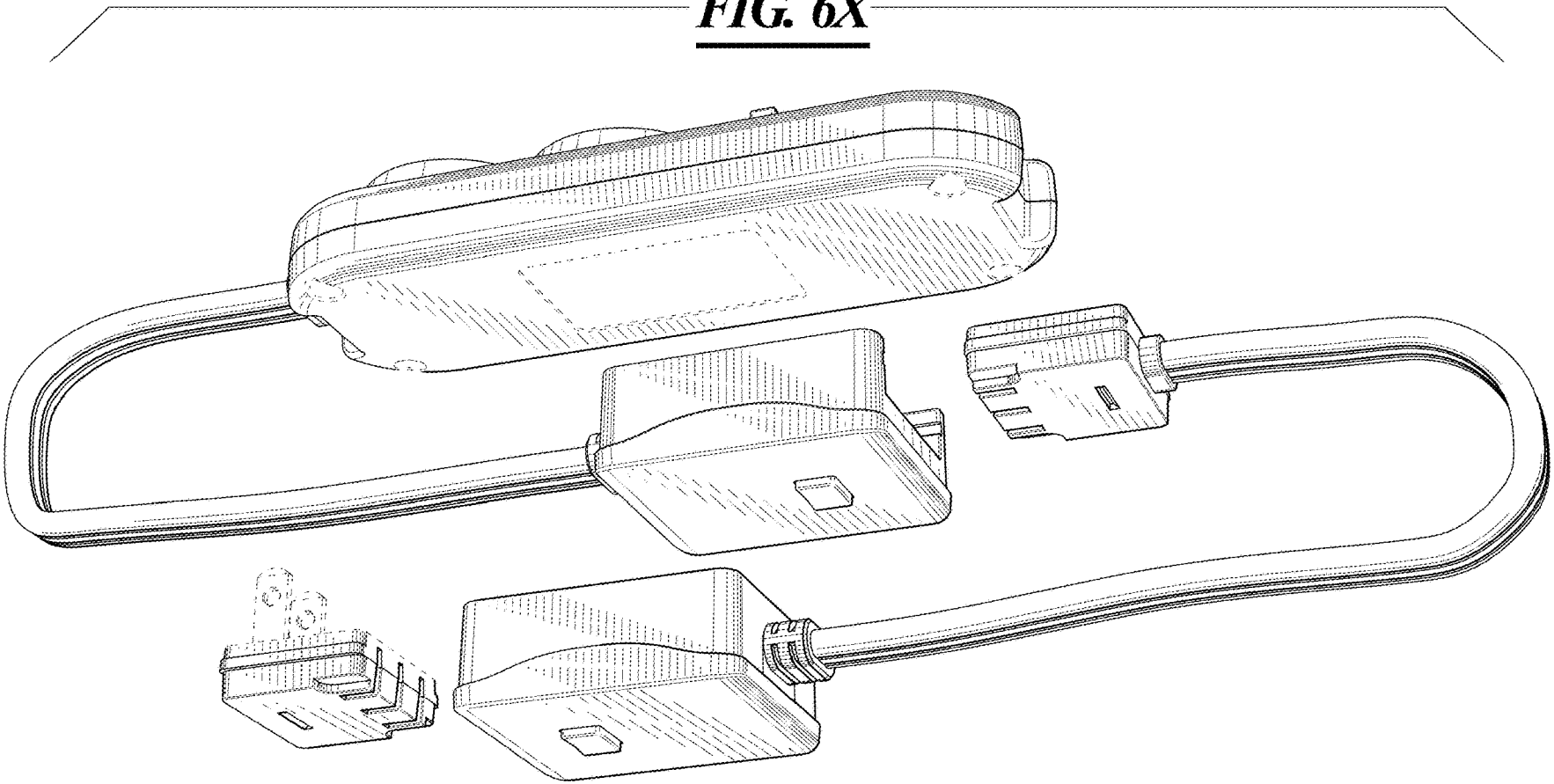
Figure 6Y:
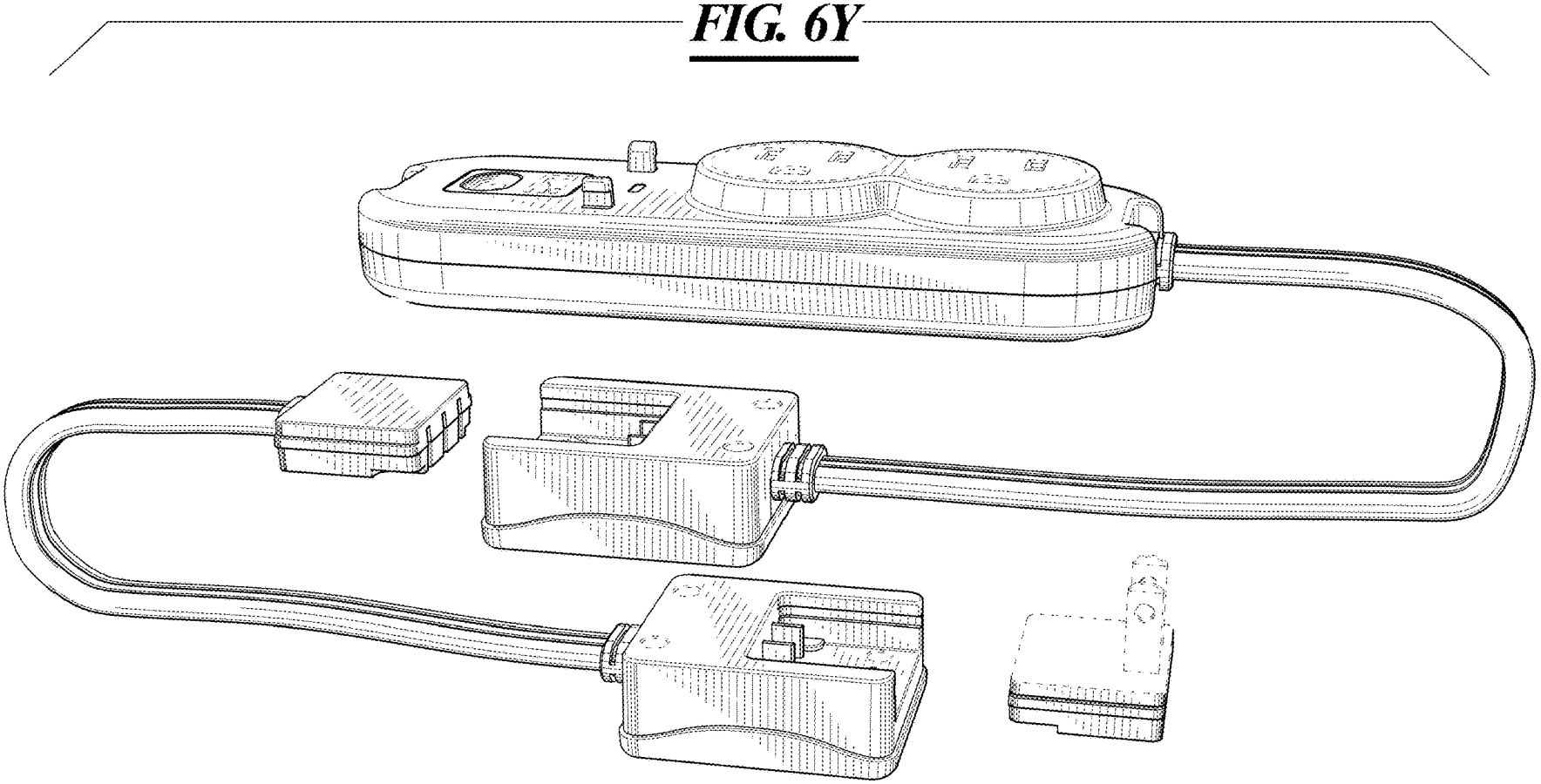
Figure 6Z:
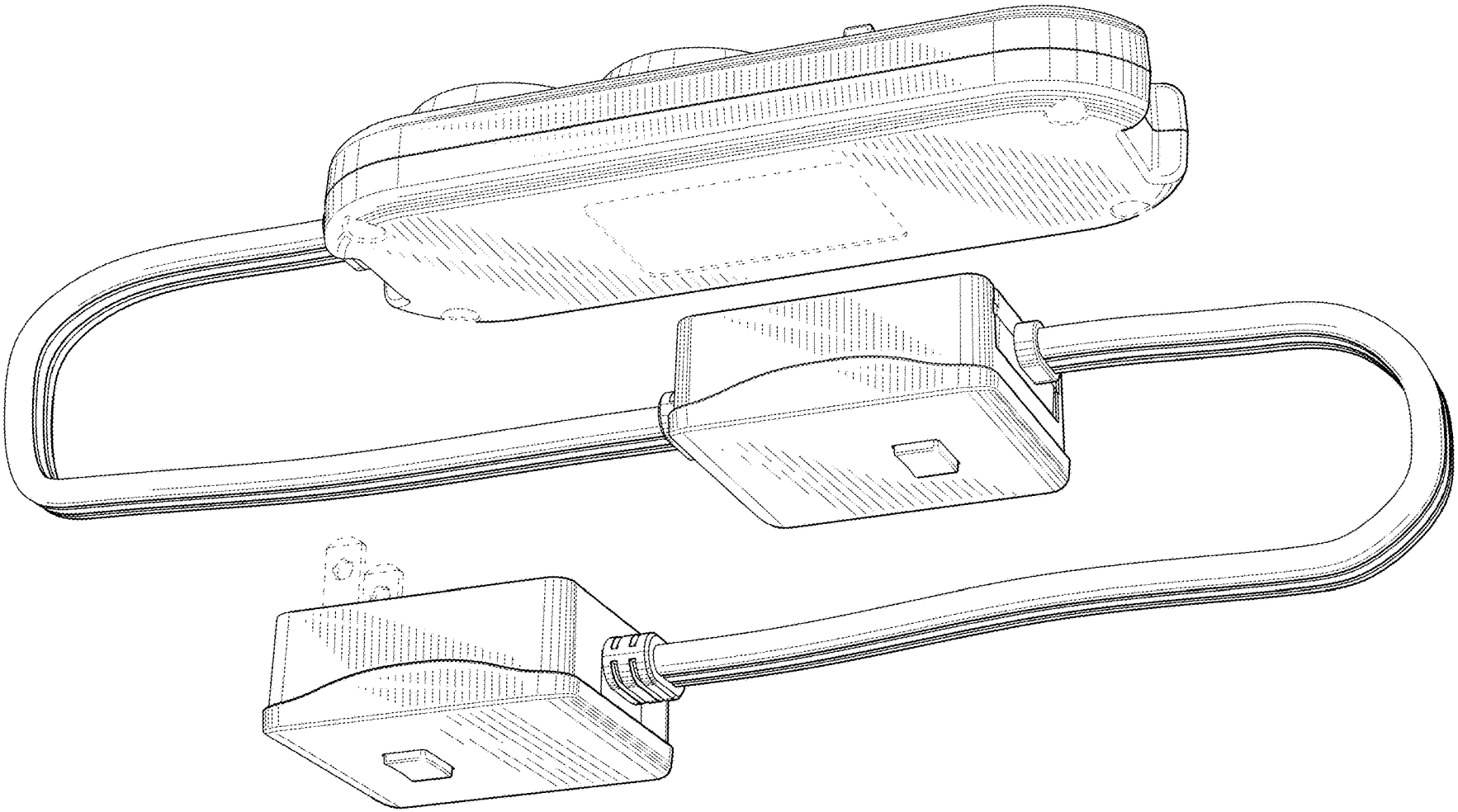
Figure 6A:
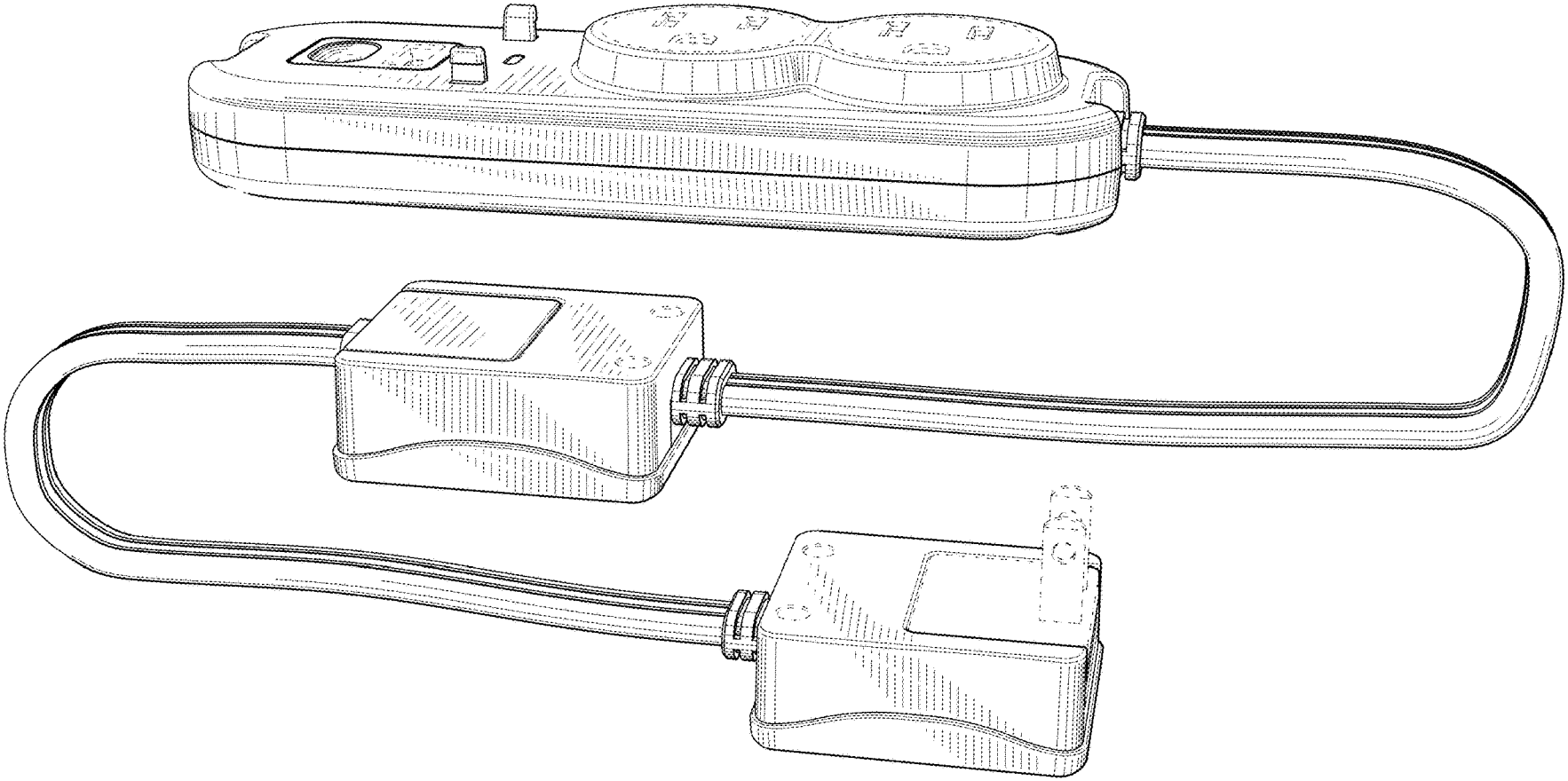
Figure 6B:
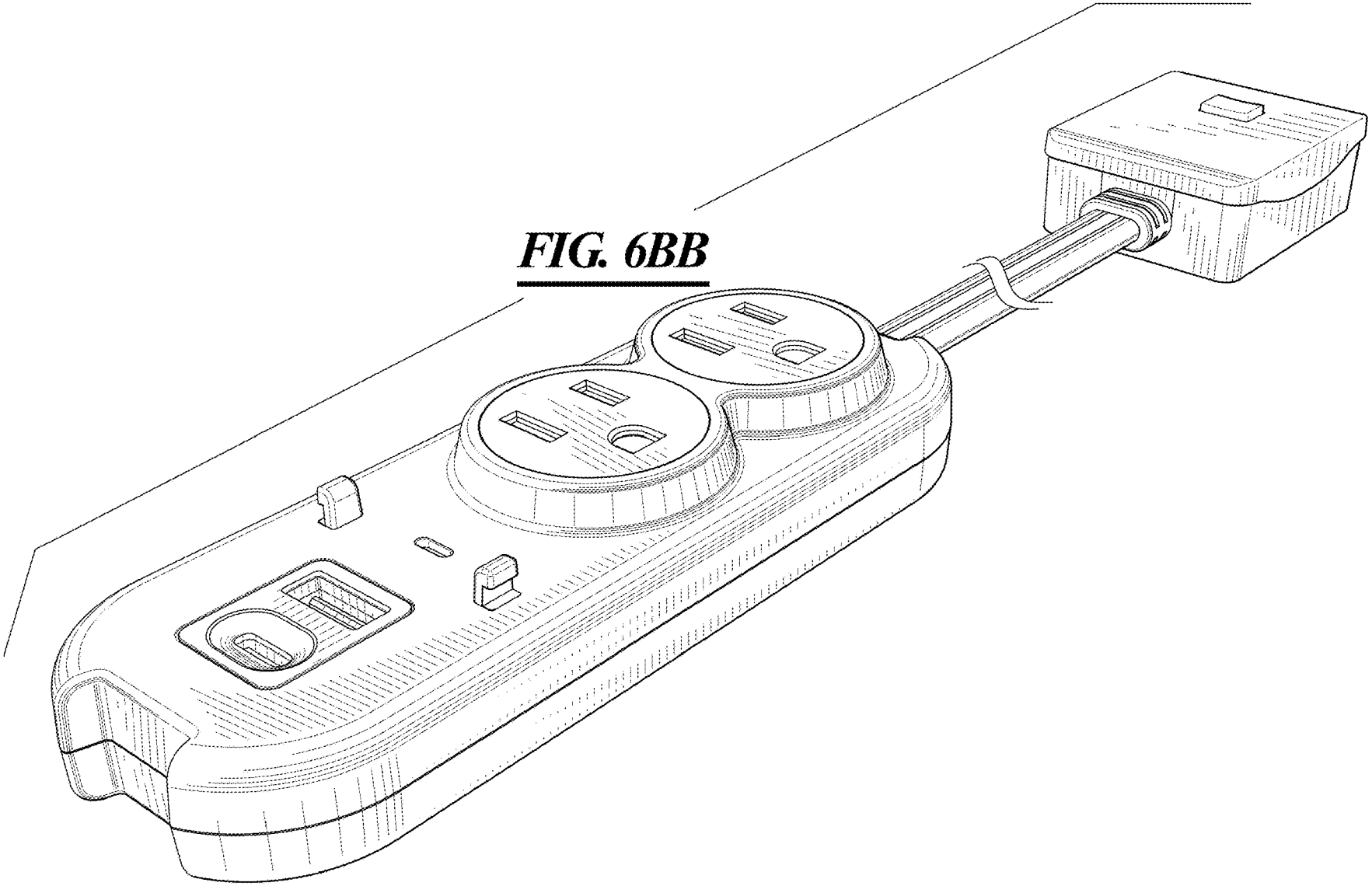

FIGS. 6A-6BB illustrate various views of a travel adapter and accompanying travel adapter extension assembly, in accordance with aspects of the disclosure.

The exemplary aspects of the present disclosure will be described with reference to the accompanying drawings. The drawing in which an element first appears is typically indicated by the leftmost digit(s) in the corresponding reference number.

DETAILED DESCRIPTION

In the following description, numerous specific details are set forth in order to provide a thorough understanding of the aspects of the present disclosure. However, it will be apparent to those skilled in the art that the aspects, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

As mentioned above, conventional travel adapters are typically large and heavy, and do not supply adequate access to power outlets or other charging means despite their considerable bulk. Therefore, to address these issues, the aspects described herein implement a compact travel adapter design that may work in conjunction with an optional extension cord.

FIGS. 1A-1F illustrate various view of an example travel adapter in accordance with an aspect of the present disclosure. As further discussed herein, the views for FIGS. 1B, 1C, 1D, and 1E have been shown in two different viewing formats. The first of these formats, designated with a −1 suffix (e.g. 1B-1), depicts the travel adapter as a black and white line drawing. The second of these formats, designated with a −2 suffix (e.g. 1B-2), depicts the travel adapter as a solid three-dimensional drawing. For each pair of drawing formats for a particular view (e.g. FIGS. 1B-1 and 1B-2), the same view of the travel adapter is shown, with the additional three-dimensional drawing format being supplied for clarity and ease of explanation. Therefore, using the previous example, throughout the disclosure references may be made to simply FIG. 1-B, with the understanding that any reference numerals or other features applies equally to both drawing formats (e.g. 1B-1 and 1B-2) for the same view of the travel adapter. Furthermore, several of the Figures included in the set of drawings labeled as 6A-6BB include components from a related design application, and have not been further revised. Thus, although several of FIGS. 6A-6BB include drawings with some components in broken lines, these broken lines do not impart any special meaning or interpretation to these components, and the broken lines in these Figures may be considered equivalent to the solid lines as shown elsewhere in FIGS. 6A-6BB.

FIG. 1A illustrates an overall three-dimensional view of the travel adapter 100. The travel adapter 100 may be implemented as a power strip, and generally divided into a plug adapter assembly 102 and a main housing 106, which are coupled to one another via a power cord 104. The travel adapter is shown in FIG. 1A in the "closed" position. As further discussed below, when in the closed position, the travel adapter 100 is most compact, as the power cord 104 is wrapped beneath the assembly of the main housing 106.

The travel adapter 100 includes, as part of the main housing 106, two receptacles 108A, 108B, which may be referred to herein as "standard," "home," or "default" receptacles. For example, the receptacles 108A, 108B may mate with an accompanying plug associated with a user's electronic devices, allowing the user to plug an electronic device power supply into each of the receptacles 108A, 108B. In the example embodiment shown in FIG. 1A, the receptacles 108A, 108B are illustrated as being compatible with a mating plug type A or type B, as defined by the International Electrotechnical Commission (IEC). These plug types A and B are used, for example, in North and Central America and Japan. However, the embodiments described herein are not limited to this particular example, and the main body 106 may include receptacles 108A, 108B having any suitable shape and/or plug type that may be identified with any country or world region. Moreover, the embodiments of the travel adapter 100 are not limited to the specific number of receptacles 108A, 108B, and may include any suitable number of receptacles 108, including a single receptacle.

As shown in FIG. 1B, the travel adapter 100 may include additional electrical ports, as well as other electrical components, in addition to the receptacles 108A, 108B. For example, the travel adapter 100 as shown in FIG. 1B includes Universal Serial Bus (USB) ports 116A, 116B, which may provide DC power in addition to the AC power provided by the receptacles 108A, 108B. The USB port 116A is implemented in this example as a female USB Type-A connector, whereas the USB port 116B is implemented in this example as a female USB Type-C connector. The configuration of USB ports as shown in FIG. 1B is by way of example and not limitation. The embodiments described herein may include any suitable number and/or type of USB ports, which may be the same or different types as one another. Moreover, the travel adapter 100 as shown in FIG. 1B includes an LED indicator 118. The LED indicator 119 may illuminate when power is being supplied by the receptacles 108A, 108B, such as when a mating adapter plug inserted into the plug adapter assembly 102 of the travel adapter 100 is plugged into an outlet of a matching plug type and is being supplied power by the outlet.

The closed position or state of the travel adapter 100 as shown in FIG. 1A may be compared to an "open" position or state of the travel adapter as shown in FIG. 1B, which illustrates a top view of the travel adapter 100 when the cord 104 is unraveled from beneath the main housing 106. However, as shown in FIG. 1B, the orientation of the plug adapter assembly 102 and the main housing 106 is the same as in FIG. 1A, with the top of the plug adapter assembly 102 and the main housing 106 being visible in each case. FIG. 1C also illustrates the travel adapter 100 in the open state, but viewed from the bottom side as opposed to the top side as shown in FIG. 1B.

With regards to the overall operation of the travel adapter 100, the power cord 104 is coupled to the plug adapter assembly 102 and the main housing 106 via respective strain reliefs 110A, 110B. The power cord 104 may be constructed of any suitable material to appropriately insulate the conductive wires included in the power cord 104 such as rubber compounds, polyvinyl chloride (PVC), etc. Moreover, the plug adapter assembly 102, the main housing 106, and the extension plug module 206 of the extension assembly 200 as noted herein may be formed of any suitable materials such as suitable polymers and/or plastic. Likewise, the strain reliefs 110A, 110B may be implemented with any suitable type of material to ensure that the power cord 104 is securely fixed to the plug adapter assembly 102 and the main housing 106. The strain reliefs 110A, 110B may be constructed from the same material, molded as part of the power cord 104, or be separate components made of materials independent of the material used for the power cord 104, in various embodiments.

The power cord 104 may include any suitable number of conductors (e.g. two, three, etc.) depending upon the particular implementation of the travel adapter 100. For instance, for compatibility with mating type B plugs, the receptacles 108A, 108B may require a live (L), neutral (N), and ground (G) connection. The power cord 104 may thus include three conductors in this example, which are not shown in the Figures for purposes of brevity. Continuing this example, the three conductors included in the extension cord 104 may be coupled to, respectively, each of L, N, and G power connections associated with a separate terminal of each of the receptacles 108A, 108B. The connections between the conductors included in the power cord 104 and the electronics included in the main housing 106 (not shown) may be made in accordance with any suitable or known techniques, and thus these connections are not further discussed herein.

The conductors included in the power cord 104 may further be coupled to terminals 126.1, 126.2, 126.3, which are included as part of the plug adapter assembly 102, and which are shown in further detail in FIGS. 1C and 1E. The terminals 126.1, 126.2, 126.3 may be made of any suitable conductive material (e.g., copper or a copper-based alloy), with each of the terminals 126.1, 126.2, 126.3 being coupled, respectively, to each one of the conductors included in the power cord 104. Again, this is by way of example and not limitation, and the number of terminals incorporated as part of the plug adapter assembly 102 may be modified to match those included in the power cord 104 and/or the electronics that are integrated as part of the main body 106 of the travel adapter 100, in various embodiments.

As shown in further detail in FIGS. 1C and 1E, in an embodiment the plug adapter assembly 102 includes a cavity or a receptacle 124. The cavity 124 is designed to accept different types of mating adapter plugs, which can be interchanged depending upon a desired plug type that is needed for a specific country or region. One example of a mating adapter plug (type A) is shown in FIG. 3, with additional mating adapter plugs shown in FIGS. 4 and 5. As shown in further detail in FIGS. 3, 4, and 5, for example, each of the mating adapter plugs may include a plug portion and a mating portion. For each of the mating adapter plugs, the plug portion includes conductive terminals that are electrically coupled to the prongs of each respective mating adapter plug. For some mating adapter plugs types (e.g. type A and type B as shown in FIGS. 4 and 5), the plug portion may include only the conductive prongs themselves, which are coupled to terminals included in the plug portion. For other mating adapter plug types (e.g., type C, type E/F, type G, and type I as shown in FIGS. 4 and 5), the plug portion may further include an additional component that is integrated as part of (e.g. molded as part of) or otherwise bonded or coupled to the mating portion, which also includes the conductive prongs that are coupled to terminals included in the plug portion. In this way, each mating adapter plug type may have a common (e.g. identical) mating portion that is configured to be inserted into the cavity 124 of the plug adapter assembly 102, which again is included as part of the travel adapter 100 and the extension assembly 200.

Thus, the terminals included in the plug portion of each mating adapter plug type may be configured to align with and electrically couple to the each one of the terminals 126.1, 126.2, 126.3, respectively, when each mating adapter plug is inserted into the cavity 124 of the plug adapter assembly 102. For example, as shown in FIGS. 4 and 5, regardless of the prong configuration of each mating adapter plug, which is specific to each plug type, each mating adapter plug may be formed with a common mating portion that interlocks within the cavity 124. In this way, the travel adapter 100 may work in conjunction with any suitable number of swappable mating adapter plugs, which may facilitate coupling, in each case, of each of the terminals 126.1, 126.2, 126.3 to any suitable type of prong configuration in accordance with any one of the IEC plug types A-N, for instance.

In an embodiment, the terminals of each one of the mating adapter plugs, which are inserted into the cavity 124 of the plug adapter assembly 102 (of either the travel adapter 100 or the extension assembly 200), may be implemented as any suitable type of electrically conductive material designed to engage with and to electrically connect with the terminals 126.1, 126.2, 126.3 of the plug adapter assembly 102. To do so, each swappable mating adapter plug may have a common mating portion that is identical or substantially similar to that of the extension plug module 206, which is shown in FIGS. 2A-2F and further discussed herein.

Thus, the cavity 124 of the plug adapter assembly 102 may accept one of the swappable mating adapter plugs when the plug adapter assembly 102 is to be plugged into a wall outlet that matches the one for which the particular plug is designed (e.g. IEC type A, IEC type C, etc.). Alternatively, and as further discussed below with reference to FIGS. 2A-2F, the cavity 124 of the plug adapter assembly 102 included in the travel adapter 100 may accept the extension plug module 206 of the extension assembly 200, and the plug adapter assembly 102 included in the extension assembly 200 may accept one of the swappable mating adapter plugs.

To ensure a secure coupling between either the extension plug module 206 or a mating adapter plug (which again has the same mating portion as the extension plug module 206) and the plug adapter assembly 102, the cavity 124 may be formed with slots or tracks 128A, 128B, as shown in FIG. 1E. The tracks 128A, 128B may be formed along the entire length of the cavity 124. For example, the tracks 128A, 128B as shown in FIG. 1E may extend along each side wall of the cavity 124 over the entire length of the cavity 124, terminating at the back wall 125 of the cavity 124 as shown in FIG. 1C, at which point the terminals 126.1, 126.2, 126.3 are fixed as part of the plug adapter assembly 102.

Moreover, and as shown in further detail in FIG. 2B, each mating adapter plug, as well as the extension plug module 206, may include tabs or rails 228A, 228B, which have a width that extends from the main body of each mating adapter plug as well as the extension plug module 206. The rail extension width, which corresponds to the extension of the rails 228A, 228B from the main body of a mating adapter plug and the extension plug module 206, as shown in FIG. 2B, are dimensioned to fit into and align with the tracks 128A, 128B within the cavity 124 of the plug adapter assembly 102, as shown in FIG. 1E. Moreover, the rail extension height, which corresponds to the thickness of the rails 228A, 228B, as shown in FIG. 2D, are dimensioned to fit into and align with the tracks 128A, 128B within the cavity 124 of the plug adapter assembly 102, as shown in FIG. 1E.

In an embodiment, each mating adapter plug and the extension plug module 206 may be coupled within the cavity 124 of the plug assembly 102 in a locking but removable manner. To do so, embodiments of the plug assembly 102 include a button 130, as shown in FIG. 1A, 1B, 1D, and 1E, which is configured to actuate a tab 132, as shown in FIGS. 1C and 1E. The button 130, as well as the tab 132, can also be viewed in FIG. 3. The tab 132 may be appropriately biased with a resilient force in any suitable manner to have a default state (i.e. a state without user intervention) in which the tab 132 is extended as shown in FIGS. 1E and 3, for example. This biasing force may be implemented in accordance with any suitable combinations of mechanical levers, springs, resilient components, etc., which are included within the housing of the plug assembly 102 but not shown for purposes of brevity. In this configuration, when a user actuates the button 130 by pressing down on it with a small degree of force, the tab 132 is retracted to a position that is substantially flush with the top 134 of the cavity 124, as shown in FIG. 1E. The retracted position of the tab 132 is not shown in the Figures for purposes of brevity, although the range of travel of the tab 132 is depicted in FIG. 1E, with the default position of the tab 132 (the button 130 not being pressed) being shown.

In an embodiment, each mating adapter plug and the extension plug module 206 also includes a divot or indentation 232, which has a size and shape configured to align and mate with the tab 132 included within the plug assembly 102 of the travel adapter 100 and the extension assembly 200. Thus, to insert each mating adapter plug, as well as the extension plug module 206, into the cavity 124 of the plug assembly 102, the rails 228A, 228B of each mating adapter plug or the extension plug module 206, as the case may be, are aligned with the tracks 128A, 128B of the plug assembly 102. The mating adapter plug or the extension plug module 206 is then further inserted into the cavity 124 of the plug assembly 102 until the indentation 232 of the mating adapter plug or the extension plug module 206 engages (i.e. interlocks with) the tab 132 of the plug assembly 102 in a locking manner due to the biasing force on the tab 132 as noted above.

The mating adapter plug (or the extension plug module 206) and the plug assembly 102, although removable, may thus remain safely and fixedly connected in this state, ensuring that the terminals 126.1, 126.2, 126.3 of the plug assembly 102 are electrically connected to matching electrical terminals included in the mating adapter plug or the extension plug module 206. This locking state is particularly useful, for instance, in the event that forces (e.g. due to weight) are applied in a direction that that would otherwise disengage the mating adapter plug (or the extension plug module 206) and the plug assembly 102. Once fixedly connected in this manner, to disconnect the mating adapter plug (or the extension plug module 206) from the plug assembly 102, a user may press the button 130, thereby retracting the tab 132 and disengaging the tab 132 from the indentation 232. Retracting the tab 132 allows a user to remove the mating adapter plug or the extension plug module 206 from the plug assembly 102 by sliding the rails 228A, 228B of the mating adapter plug (or the extension plug module 206) along the tracks 128A, 128B of the plug assembly 102 in the opposite direction as noted above with regards to the insertion of the mating adapter plug (or the extension plug module 206) into the plug assembly 102.

Again, a mating adapter plug is inserted into the plug assembly 102 of the travel adapter 100 or the extension assembly 200, and the mating adapter plug is then plugged into the matching plug type to enable a user to plug a "home" electrical component into the receptacles 108A, 108B and/or the USB ports 116A, 116B. In any event, the travel adapter 100 is in the open state during ordinary use, which may optionally include the use of the accompanying extension cord 200 as discussed in further detail herein. Embodiments also include the travel adapter 100 being placed into the closed state, as shown in FIG. 1A, when the travel adapter 100 is not in use. The embodiments described herein enable the travel adapter to be placed into the closed state to provide a compact, safe, and secure means of storage and transportation of the travel adapter 100.

To do so, embodiments include the main housing 106 of the travel adapter 100 being formed with tabs, rails, or projections 114A, 114B. The projections 114A, 114B, examples of which are shown in FIGS. 1B, 1D, and 1F, may be formed as an integrated part of (e.g. molded as part of) or otherwise bonded or coupled to the main housing 106. The projections 114A, 114B have a curved shape, with each initially projecting substantially perpendicular to the surface of the main housing 106, and then turning outward in a direction that is substantially parallel to the width dimension of the main housing 106 (e.g. in the X direction as shown in FIG. 1A).

As shown in FIG. 1E, the rail extension width and the rail extension height of the rails 228A, 228B of the extension plug module 206 (which also correspond to the rails included in the mating adapter plugs) is superimposed onto the projections 114A, 114B of the main housing 106, indicating that the dimensions of the projections 114A, 114B enable the tracks 128A, 128B of the plug assembly 102 to also mate and align with the projections 114A, 114B. In other words, the width, height, and shape of the projections 114A, 114B enable the plug assembly 102 to mate with this portion of the main housing 106 in a similar manner as the plug assembly 102 mates with the mating adapter plugs.

In an embodiment, to place the travel adapter 100 into the closed state, the cord 104 is first wrapped beneath the main housing 106 as shown in FIG. 3. Next, the plug assembly 102 is rotated from the view shown in FIG. 3 such that the bottom of the plug assembly 102 is placed onto the top of the main housing 106. Finally, the plug assembly 102 is moved in the direction of the receptacles 108A, 108B, allowing the projections 114A, 114B to slide into and engage with the tracks 128A, 128B of the plug assembly 102. The travel adapter 100 is thus placed into the closed state, as shown in FIG. 1A. As further discussed below, the design of the travel adapter 100 facilitates the power cord 104 and the plug assembly 102 being securely fixed in this closed state, ensuring a compact form and preventing the plug assembly from detaching from the main housing 106 when stored in this way. To do so, various components of the travel adapter 100 are configured to work in conjunction with one another to captivate the plug assembly 102 and the power cord 104 with respect to the main housing 106 in the closed state. This is further discussed below with reference to the X, Y, and Z directions as shown in FIG. 1A.

For instance, once the plug assembly 102 is engaged or mated with the main housing 106, the extension of the projections 114A, 114B by the rail extension width as shown in FIG. 1E into the tracks 128A, 128B of the plug assembly 102 prevent movement of the plug assembly 102 in both the X and the Z directions. Also, and with further reference to FIG. 1B, the main housing 106 includes a notch 112 through which the power cord 104 is passed as the plug assembly 102 engages with the main housing 106. Although FIG. 1B-2 illustrates the power cord 104 being shorter than the length of the main body housing, this is by way of example and to allow the entire image to meet page formatting constraints. In an embodiment, the power cord 104 (including the accompanying strain reliefs 110A, 110B) is actually of a particular length that is slightly longer than the length 'L1' of the main housing 106 (e.g., 5% longer, 10% longer, 15% longer, etc.), such that there is some slack in the power cord 104 when the travel adapter 100 is in the closed state. Thus, the power cord 104 may be pulled with a degree of force in a direction away from the notch 112 to take up this slack and to place the bottom of the plug assembly 102 flush with the top of the main housing 106.

The flush positioning of the plug assembly 102 onto the top surface of the main housing 106 may be used to align the tracks 128A, 128B of the plug assembly 102 with the projections 114A, 114B of the main housing 106 prior to further sliding the plug assembly 102 into the main housing 106 (while relieving the strain on the power cord 104 caused by pulling the power cord 104 away from the notch 112) to place the travel adapter in the closed state. The pulling force on the power cord 104 that ensures that the bottom of the plug assembly 102 is flush with the top of the main housing 106 need not be excessive, but may act to temporarily remove the slack in the power cord 104. For example, the user may pull the plug assembly 102 with enough force to temporarily take up the slack in the power cord 104 and to overcome the natural resiliency in the power cord 104 and the strain reliefs 110A, 110B.

Thus, once the plug assembly 102 is engaged with the main housing 106 in the closed state by overcoming the biasing force caused by the power cord 104 (together with the strain reliefs 110A, 110B) the plug assembly 102 is mated with the main housing 106 in the closed state. This is facilitated by the projections 114A, 114B of the main housing 106 engaging with the tracks 128A, 128B of the plug assembly 102 a small distance from the open end of the cavity 124 (e.g., a ¼", a ½", etc.). Therefore, in this closed state, the plug assembly 102 is substantially captivated in the Y direction as well, as an additional force needs to be applied by the user in the −Y direction (away from the receptacles 108A, 108B and the notch 112) to once again take up the slack in the power cord 104 and remove the plug assembly 102 from the main housing 102. The notch 112, through which the power cord 104 is passed, further holds the power cord 104 in place in the closed position (see FIG. K), and prevents the plug assembly 102 from twisting within the X-Y plane, which would otherwise cause the plug assembly 102 to decouple from the main housing 106 (e.g. if the plug assembly 102 moves enough such that the projections 114A, 114B are positioned outside the cavity 124). Moreover, the specific direction and degree of force required to separate the plug assembly 102 from the main housing 106 is unlikely to accidentally be applied during transport, thus ensuring that the travel adapter 100 remains in the closed state until the user decides otherwise.

In this way, the interlocking nature of the components of the travel adapter 100 advantageously provide a compact storage solution when the travel adapter is in the closed state without requiring additional fasteners or cord management solutions. Moreover, in the closed state, the plug assembly 102 also covers the USB ports 116A, 116B as indicated in FIG. 1B by the length 'L2,' providing some protection against dirt and debris entering the travel adapter 100 via these USB ports.

Again, the extension assembly 200, which is shown in FIGS. 2A-2F in various views, may be used in conjunction with the travel adapter 100. Thus, as further discussed above, various components of the extension assembly 200 may be identical or substantially similar to components of the travel adapter 100. For instance, the extension assembly 200 may include a plug adapter assembly 102 that is the same as the plug adapter assembly 102 discussed herein with reference to the travel adapter 100. Moreover, the extension assembly 200 may include an extension cord 204, which couples the extension plug module 206 and the plug adapter assembly 102 of the travel adapter 100 to one another.

The extension cord 204 may be made of a similar or identical material as the power cord 104 as discussed above with reference to the travel adapter 100, although the extension cord 204 may be longer (e.g., twice as long, five times longer, ten times longer, etc.) than the power cord 104 to provide additional length between a power outlet and the main body 106 of the travel adapter assembly 100. Moreover, the extension cord 204 may function to couple electrical conductors included in the extension cord 204 with matching terminals located on the plug module 206 and the plug adapter assembly 102. In this way, the extension assembly 200 enables a user to extend the length of the power cord 104 by mating the extension plug module 206 of the extension assembly 200 with the plug adapter assembly 102 of the travel adapter 100. In this case, the mating adapter plugs are inserted into the plug adapter assembly 102 of the extension assembly 200 instead of the plug adapter assembly 102 of the travel adapter 100. Thus, when the extension assembly 200 is used with the travel adapter 100, any of the mating adapter plugs as discussed herein may be alternatively inserted into the plug adapter assembly 102 of the extension assembly 200, and the extension plug module 206 may be inserted into the plug adapter assembly 102 of the travel adapter 100. Examples of the usage of the travel adapter 100 with the extension assembly 200 are further shown in FIGS. 6P, 6Q, 6R, 6S, 6X, 6Y, 6Z, and 6AA.

CONCLUSION

The drawings included with and referenced throughout this disclosure are provided as examples and for ease of explanation. The drawings may be, but need not be, considered as being to scale.

The aforementioned description of the specific aspects will so fully reveal the general nature of the disclosure that others can, by applying knowledge within the skill of the art, readily modify and/or adapt for various applications such specific aspects, without undue experimentation, and without departing from the general concept of the present disclosure. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one aspect," "an aspect," "an exemplary aspect," etc., indicate that the aspect described may include a particular feature, structure, or characteristic, but every aspect may not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The exemplary aspects described herein are provided for illustrative purposes, and are not limiting. Other exemplary aspects are possible, and modifications may be made to the exemplary aspects. Therefore, the specification is not meant to limit the disclosure. Rather, the scope of the disclosure is defined only in accordance with the following claims and their equivalents.

What is claimed is:

1. A travel adapter, comprising:

a main housing; and a plug adapter assembly coupled to the main housing via a power cord, the plug adapter assembly including a cavity configured to mate with a mating adapter plug by alignment of a set of tracks included in the cavity with a set of rails included in the mating adapter plug, wherein the main housing includes a set of projections configured to engage with the set of tracks included in the cavity of the plug adapter assembly to enable the main housing to mate with the plug adapter assembly.

2. The travel adapter of claim 1, wherein the travel adapter is configured to be in placed in an open state during use and in a closed state for storage when not in use, and wherein the travel adapter is placed in the closed state by mating the main housing with the plug adapter assembly.

3. The travel adapter of claim 2, wherein the main housing includes at least one Universal Serial Bus (USB) port, and wherein the plug adapter assembly covers the at least one USB port when the travel adapter is in the closed state.

4. The travel adapter of claim 2, wherein main body includes at least one receptacle that is positioned on a top side of the main body, and wherein the power cord is routed beneath the main body on a bottom side that is opposite to the top side when the travel adapter is in the closed state.

5. The travel adapter of claim 4, wherein the main body includes a notch through which the power cord is routed from the bottom side of the main body when the travel adapter is in the closed state.

6. The travel adapter of claim 2, wherein the main body includes a notch through which the power cord is routed when the travel adapter is in the closed state, the notch being positioned at a first end of the main body that is opposite to a second end of the main body to which the power cord is coupled.

7. The travel adapter of claim 6, wherein the plug adapter assembly is captivated via engagement of the set of projections on the main body with the set of tracks included in the cavity of the plug adapter assembly when the travel adapter is in the closed state, and wherein the plug adapter assembly is removed from the main body to place the travel adapter in the open state by applying a force moving the plug adapter assembly in a direction away from the notch in the main body.

8. The travel adapter of claim 1, wherein the plug adapter assembly includes a tab that is biased with a resilient force, the tab being configured to interlock with an indentation included in the mating adapter plug to couple the plug adapter assembly with the mating adapter plug.

9. The travel adapter of claim 8, wherein the plug adapter assembly includes a button configured to retract the tab included in the plug adapter assembly when the button is pressed, and wherein the plug adapter assembly is configured, upon the button being pressed, to disengage the tab from the indentation included in the mating adapter plug to enable the plug adapter assembly to be decoupled from the mating adapter plug.

10. The travel adapter of claim 1, wherein the power cord has a length that is longer than a length of the main body of the travel adapter.

11. A travel adapter and extension cord assembly, comprising:

a travel adapter including a main housing and a first plug adapter assembly coupled to the main housing via a power cord; and an extension assembly including an extension plug module and a second plug adapter assembly coupled to the extension plug module via an extension cord, wherein the first plug adapter assembly includes a first plug adapter cavity configured to mate with the extension plug module by alignment of a set of tracks included in the first plug adapter cavity with a set of rails included in the extension plug module, wherein the second plug adapter assembly includes a second plug adapter cavity configured to mate with a mating adapter plug by alignment of a set of tracks included in the second plug adapter cavity with a set of rails included in the mating adapter plug, and wherein the main housing includes a set of projections configured to engage with the set of tracks included in the first plug adapter cavity to mate the main housing with the first plug adapter assembly.

12. The travel adapter and extension cord assembly of claim 11, wherein the first plug adapter assembly is identical to the second plug adapter assembly.

13. The travel adapter and extension cord assembly of claim 11, wherein the mating adapter plug has a mating portion that is identical to the extension plug module.

14. The travel adapter and extension cord assembly of claim 11, wherein the power cord has a length that is longer than a length of the main body of the travel adapter, and wherein the extension cord has a length that is longer than the power cord.

15. The travel adapter and extension cord assembly of claim 11, wherein the travel adapter is configured to be in placed in an open state during use and in a closed state for storage when not in use, the open state including the extension plug module being mated to the first plug adapter assembly.

16. The travel adapter and extension cord assembly of claim 15, wherein the mating adapter plug is further mated to the second plug adapter assembly when the travel adapter is placed in the open state.

17. The travel adapter and extension cord assembly of claim 11, wherein the travel adapter is configured to be in placed in an open state during use and in a closed state for storage when not in use, and wherein the first plug adapter assembly is mated to the main housing of the travel adapter to place the travel adapter in the closed state.

18. An extension cord assembly, comprising:

an extension plug module; and a plug adapter assembly coupled to the extension plug module via a power cord, wherein the plug adapter assembly includes a plug adapter cavity configured to mate with a mating adapter plug by alignment of a set of tracks included in the plug adapter cavity with a set of rails included in the mating adapter plug, and wherein the extension plug module is configured to mate with another plug adapter assembly associated with a travel adapter.

19. The extension cord assembly of claim 18, wherein the plug adapter assembly is identical to the another plug adapter assembly associated with a travel adapter.

20. The extension cord assembly of claim 18, wherein the mating adapter plug has a mating portion that is identical to the extension plug module.

* * * * *